US010378293B2

(12) United States Patent
Sanchez

(10) Patent No.: US 10,378,293 B2
(45) Date of Patent: Aug. 13, 2019

(54) ASYMMETRIC CASING CENTRALIZER

(71) Applicant: Top-Co, Inc., Houston, TX (US)

(72) Inventor: Alfredo Sanchez, Tomball, TX (US)

(73) Assignee: TOP-CO INC., Houston, TX (US)

( * ) Notice: Subject to any disclaimer, the term of this patent is extended or adjusted under 35 U.S.C. 154(b) by 38 days.

(21) Appl. No.: 15/607,430

(22) Filed: May 26, 2017

(65) Prior Publication Data

US 2017/0362903 A1 Dec. 21, 2017

Related U.S. Application Data

(60) Provisional application No. 62/342,812, filed on May 27, 2016.

(51) Int. Cl.
*E21B 17/10* (2006.01)
*E21B 33/14* (2006.01)

(52) U.S. Cl.
CPC ..... *E21B 17/1078* (2013.01); *E21B 33/14* (2013.01)

(58) Field of Classification Search
CPC ..... E21B 17/1078; E21B 17/10; E21B 17/00; E21B 17/1007; E21B 17/1057; E21B 33/14
See application file for complete search history.

(56) References Cited

U.S. PATENT DOCUMENTS 4,984,633 A 1/1991 Langer et al.
6,871,706 B2 3/2005 Hennessey

FOREIGN PATENT DOCUMENTS

CN 202148874 U 2/2012
WO 2013120192 A1 8/2013

OTHER PUBLICATIONS

United States International Searching Authority; International Search Report & Written Opinion for PCT/US2017/034882; 11 pages; dated Sep. 21, 2017; Alexandria, VA; US.
International Preliminary Report on Patentability and the Written Opinion of the International Searching Authority as issued in International Patent Application No. PCT/US2017/034882, dated Dec. 6, 2018.

*Primary Examiner* — Yong-Suk Ro
(74) *Attorney, Agent, or Firm* — Pillsbury Winthrop Shaw Pittman LLP

(57) ABSTRACT

Asymmetric casing centralizers are provided with varying flow resistances caused by a combination of straight vanes and spiral vanes; as a result, the casing centralizer has varying pressure drops thereacross when the casing centralizer is positioned within a preexisting structure such as, for example, a horizontal wellbore section that traverses one or more subterranean formations.

20 Claims, 40 Drawing Sheets

TOP-VIEW

SECTION N-N

SECTION R-R

SECTION P-P

TOP-VIEW

RHx = RADIAL HEIGHT x
RHF > RHE > RHD > RHC > RHB > RHA

TOP-VIEW

DURING INSERTION OF CASING AND CASING CENTRALIZER IN WELLBORE, SPIRAL VANES URGE CASING CENTRALIZER TO ROTATE, RELEATIVE TO CASING

"SNOW SHOE" STRAIGHT VANES TO INCREASE FOOTPRINT SO THAT VANE DOESN'T SINK INTO EARTH

ASYMMETRIC CASING CENTRALIZER

CROSS-REFERENCE TO RELATED APPLICATION(S)

The present application claims the benefit of provisional U.S. Patent Application No. 62/342,812, entitled "SELF-ALIGNING CASING CENTRALIZER HAVING VARYING FLOW RESISTANCES" filed on May 27, 2016, the entirety of which is herein incorporated by reference.

BACKGROUND

Field of the Disclosure

This disclosure relates in general to oil and gas exploration and production operations and, in particular, to casing centralizers for centralizing a casing within a wellbore, to facilitate oil and gas exploration and production operations.

Background of the Disclosure

A casing centralizer operates to center, or centralize, a tubular string or casing within a wellbore used in oil and gas exploration and production operations. This centralization facilitates the insertion of cement in an annular region defined between the outside surface of the casing and the wall of the wellbore. In some cases, and especially in horizontal wellbore sections, a maldistribution of flowing cement is created because the casing centralizer settles on the bottom of the horizontal wellbore wall, creating a pressure drop longitudinally across the casing centralizer at the bottom of the horizontal wellbore wall (Delta P1) that is greater than the pressure drop longitudinally across the casing centralizer at the top of the horizontal wellbore wall (Delta P2) (i.e., Delta P1>Delta P2). Flow of cement is choked at the bottom of the horizontal wellbore wall, creating a maldistribution of cement flow in the annular region. Therefore, what is needed is a casing centralizer or method that addresses one or more of the foregoing issues, and/or other issues.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION OF THE DRAWINGS

Figure 1:
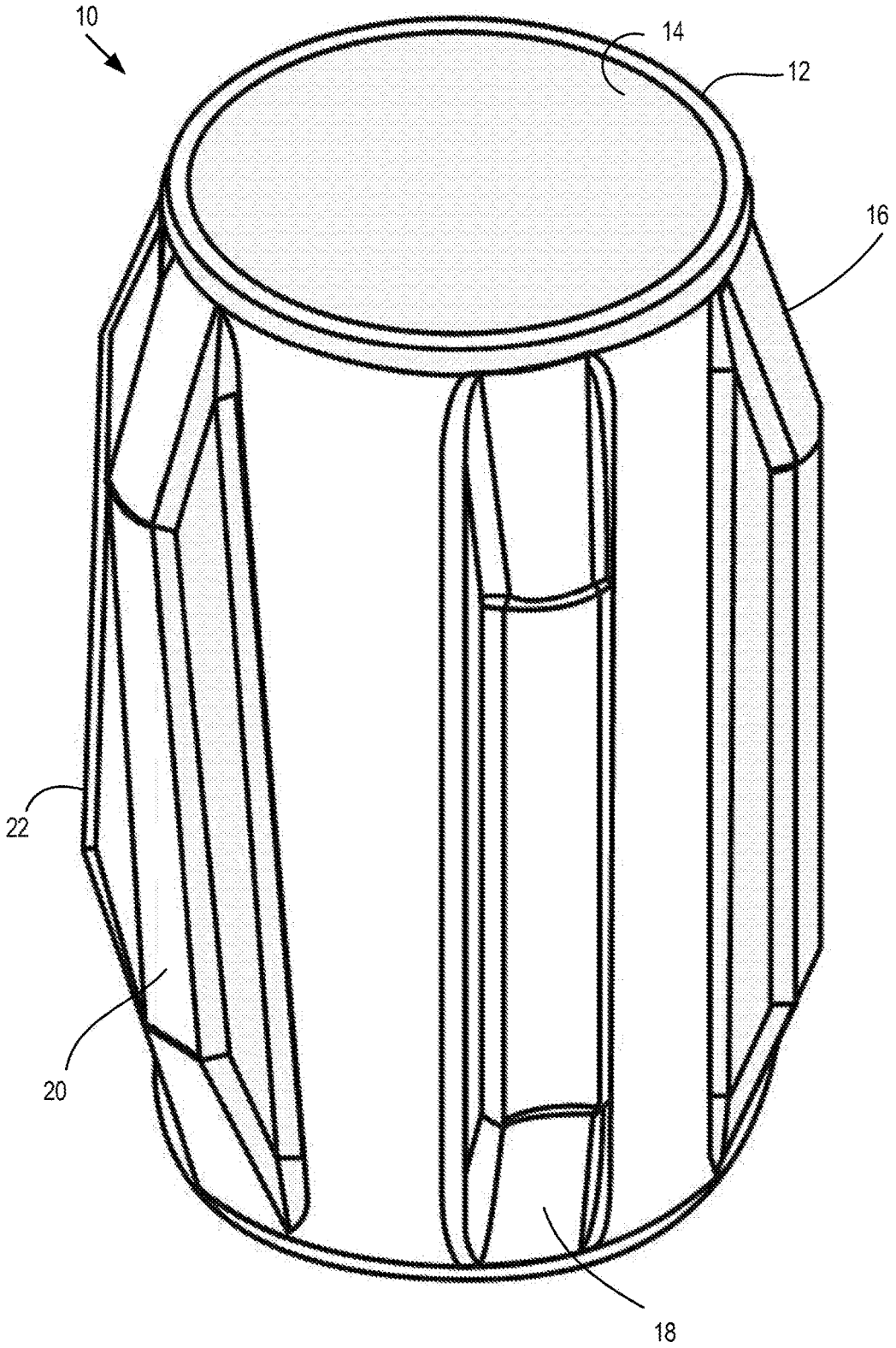
FIGS. 1-13 include views of a casing centralizer, according to an exemplary embodiment of the present disclosure.
Figure 2:
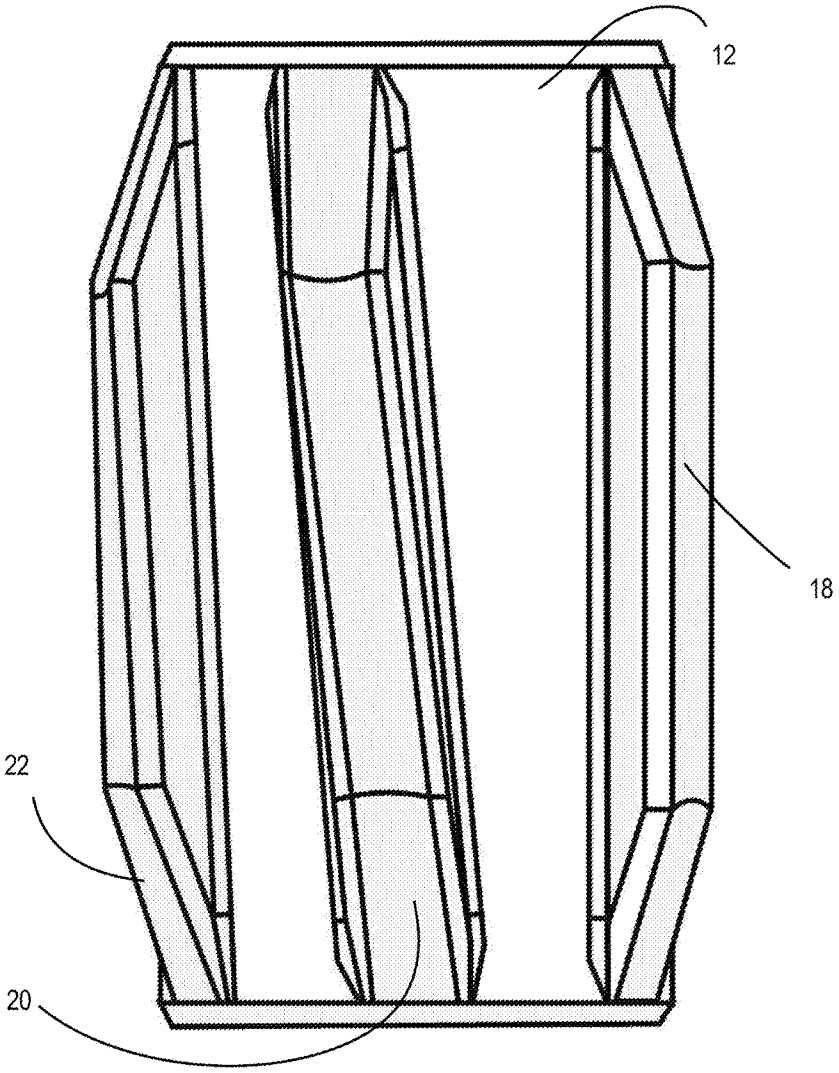
Figure 3:
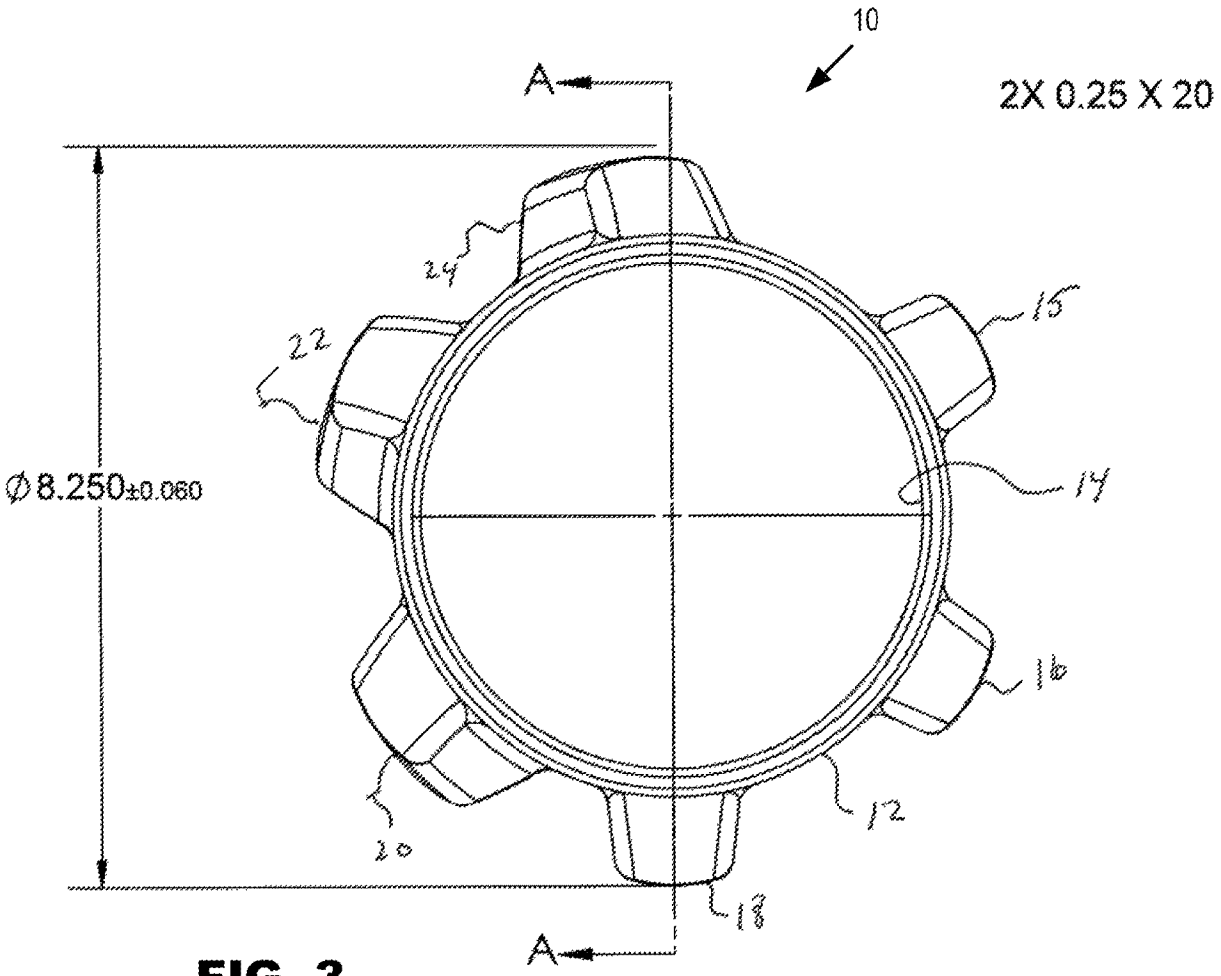
Figure 4:
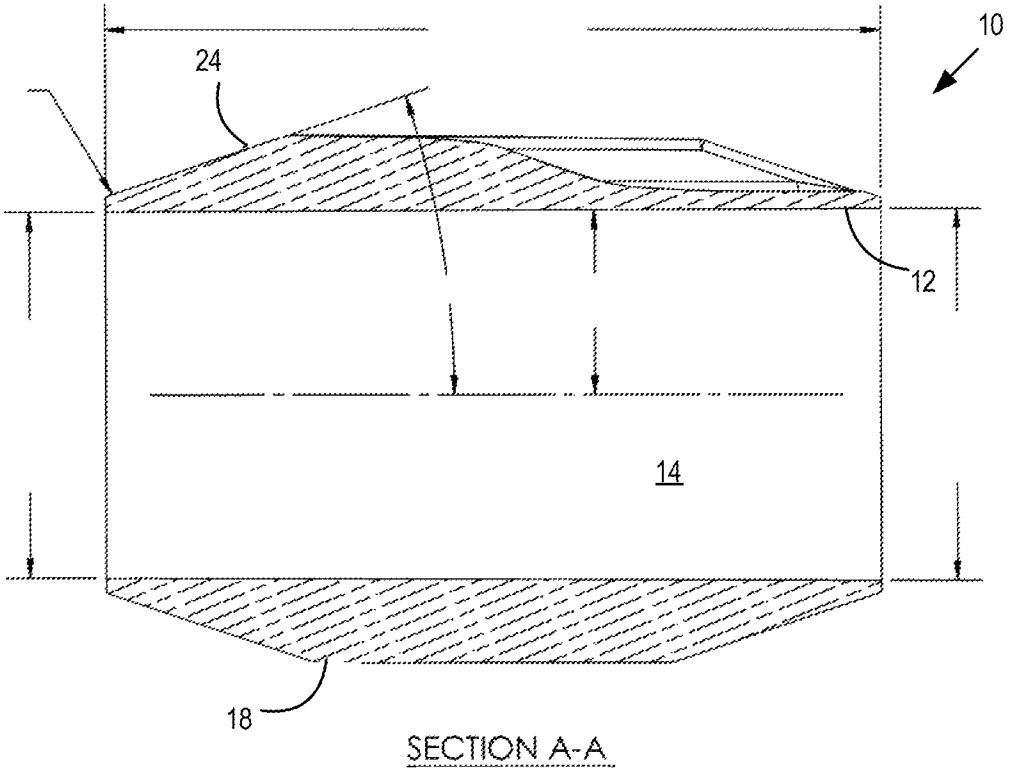
Figure 5:
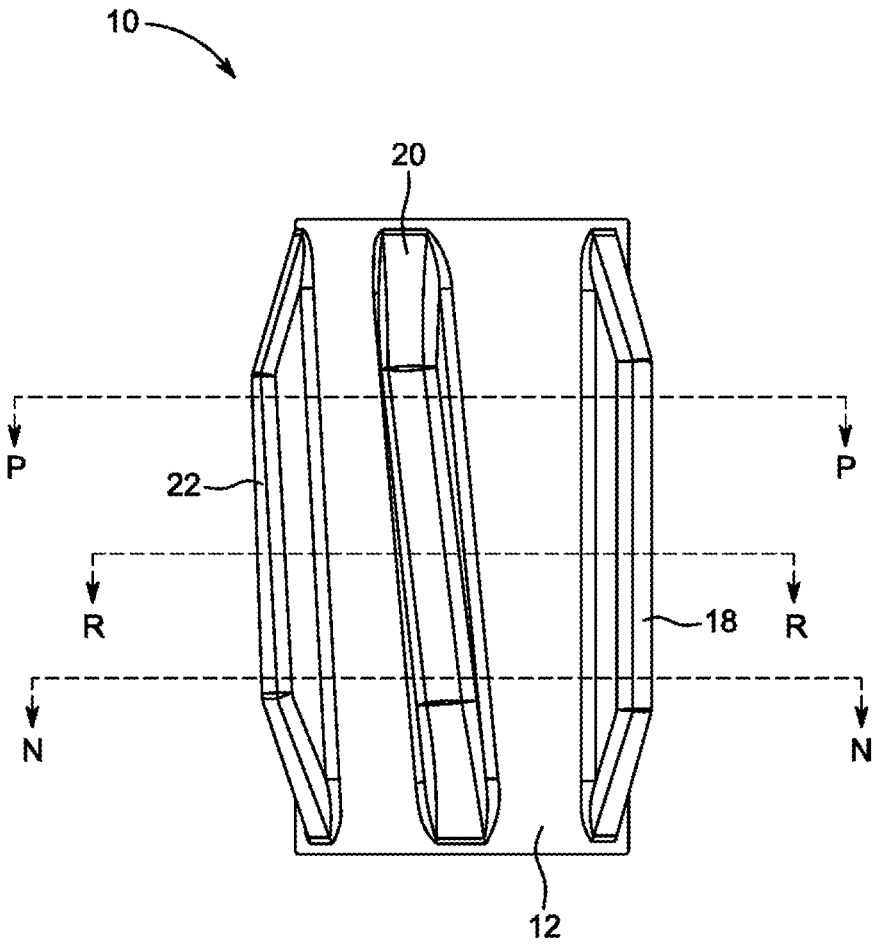
Figure 6:
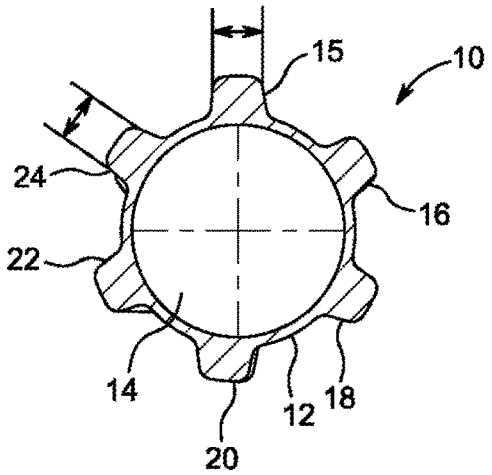
Figure 6:
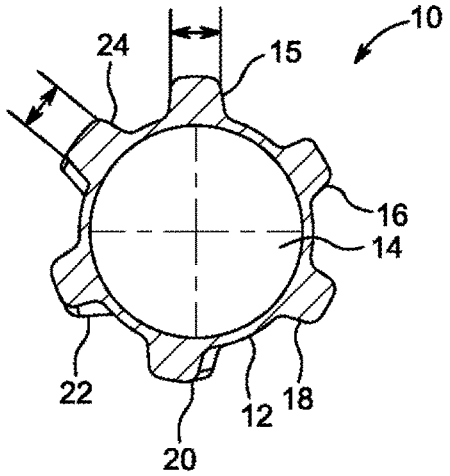
Figure 6:
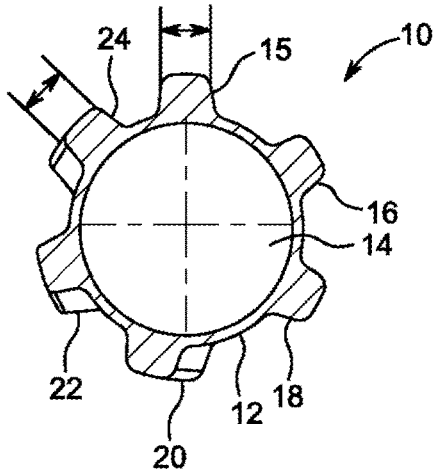
Figure 7:
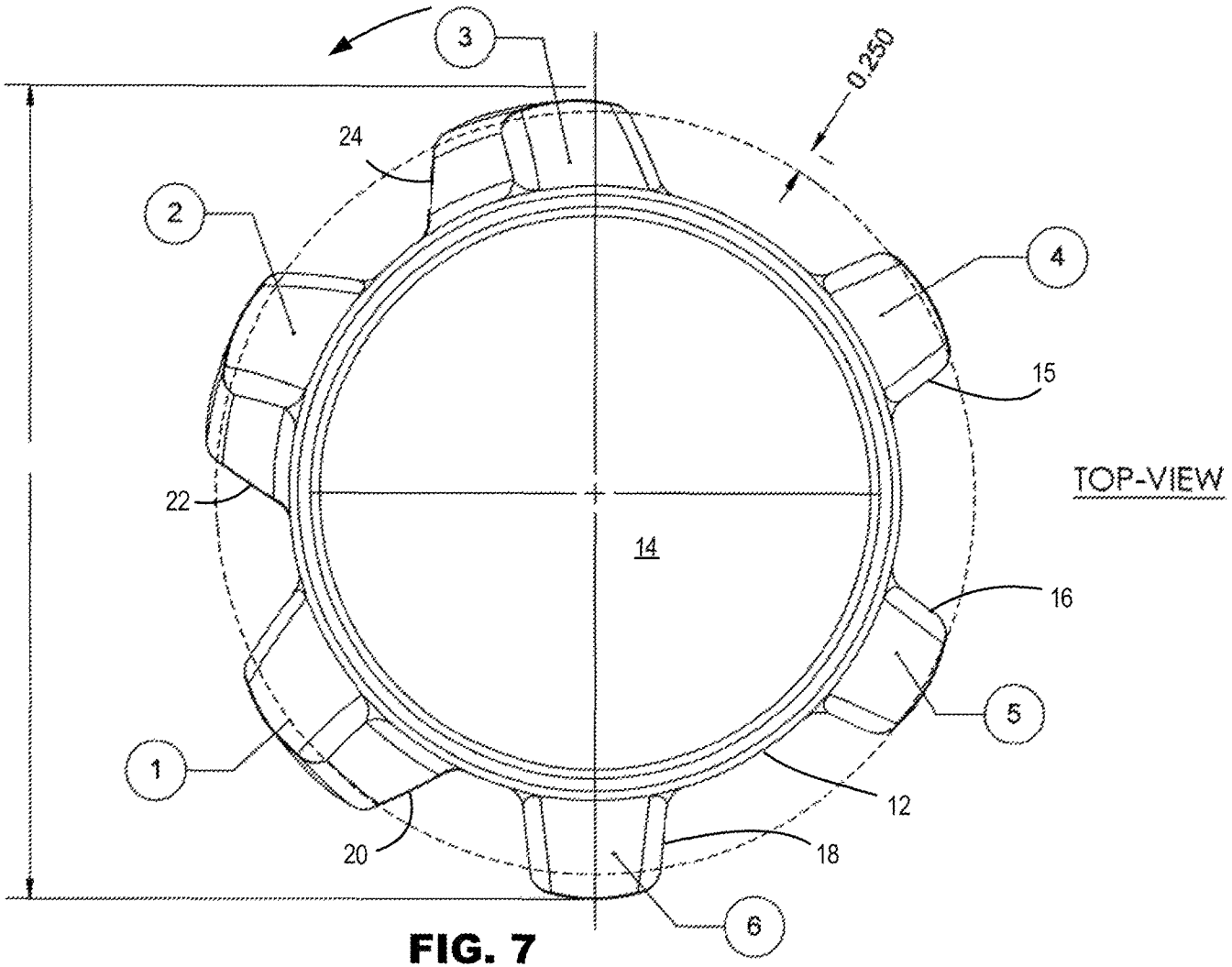
Figure 8:
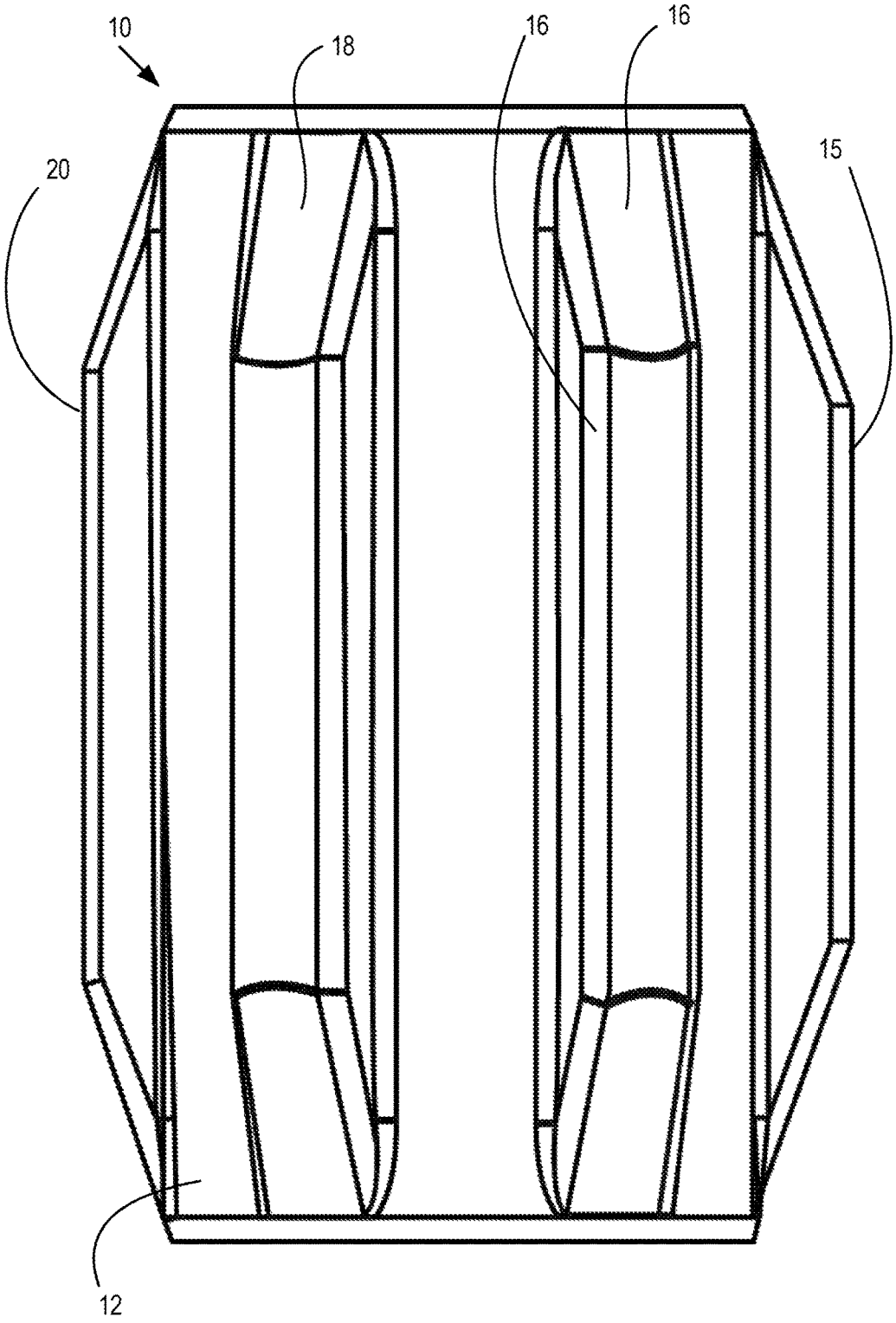
Figure 9:
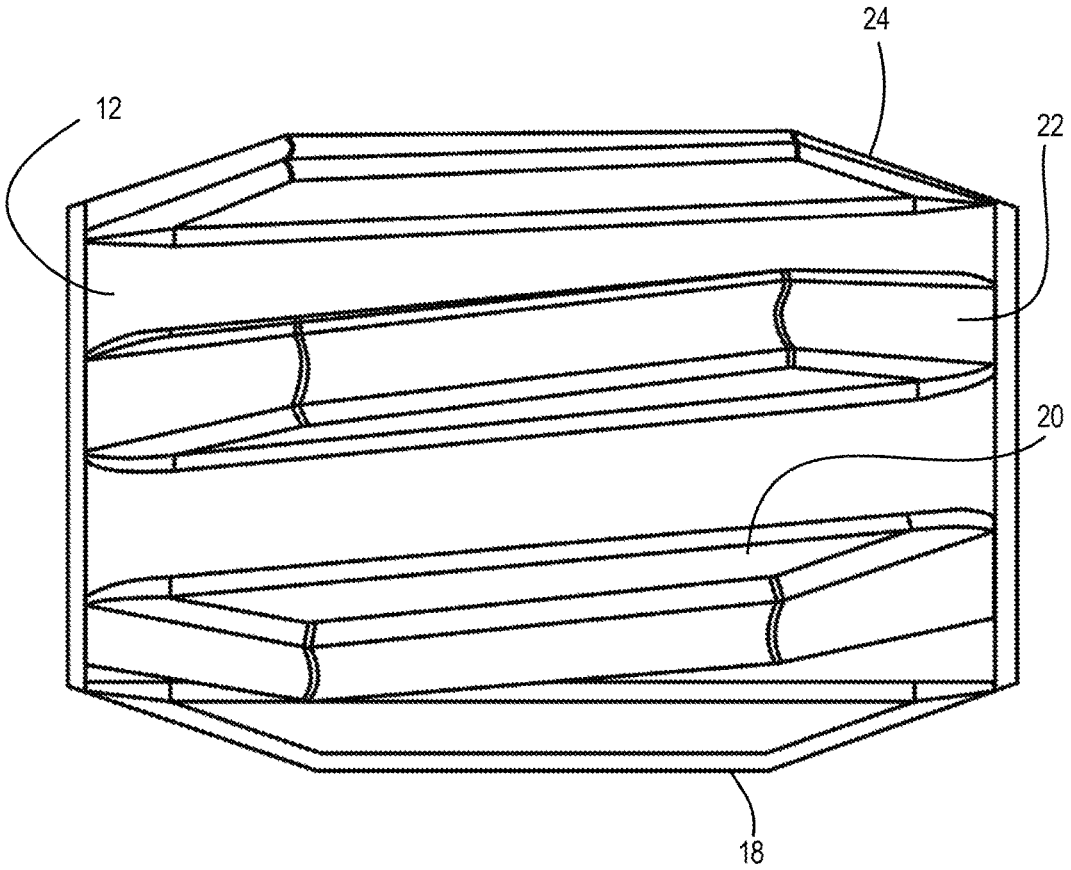
Figure 10:
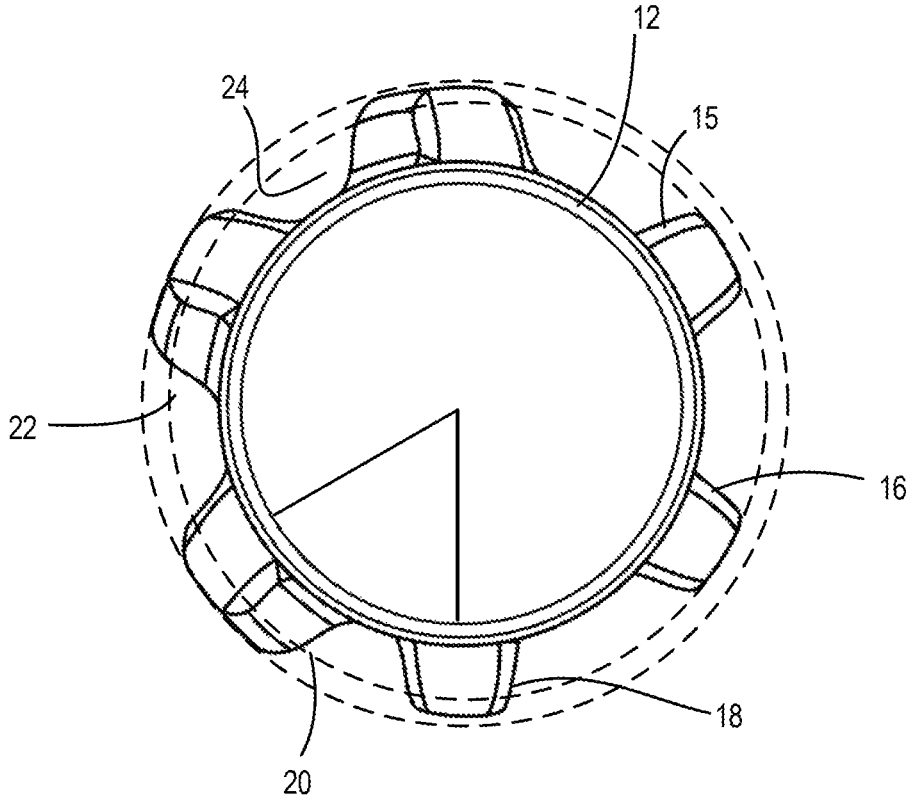
Figure 11:
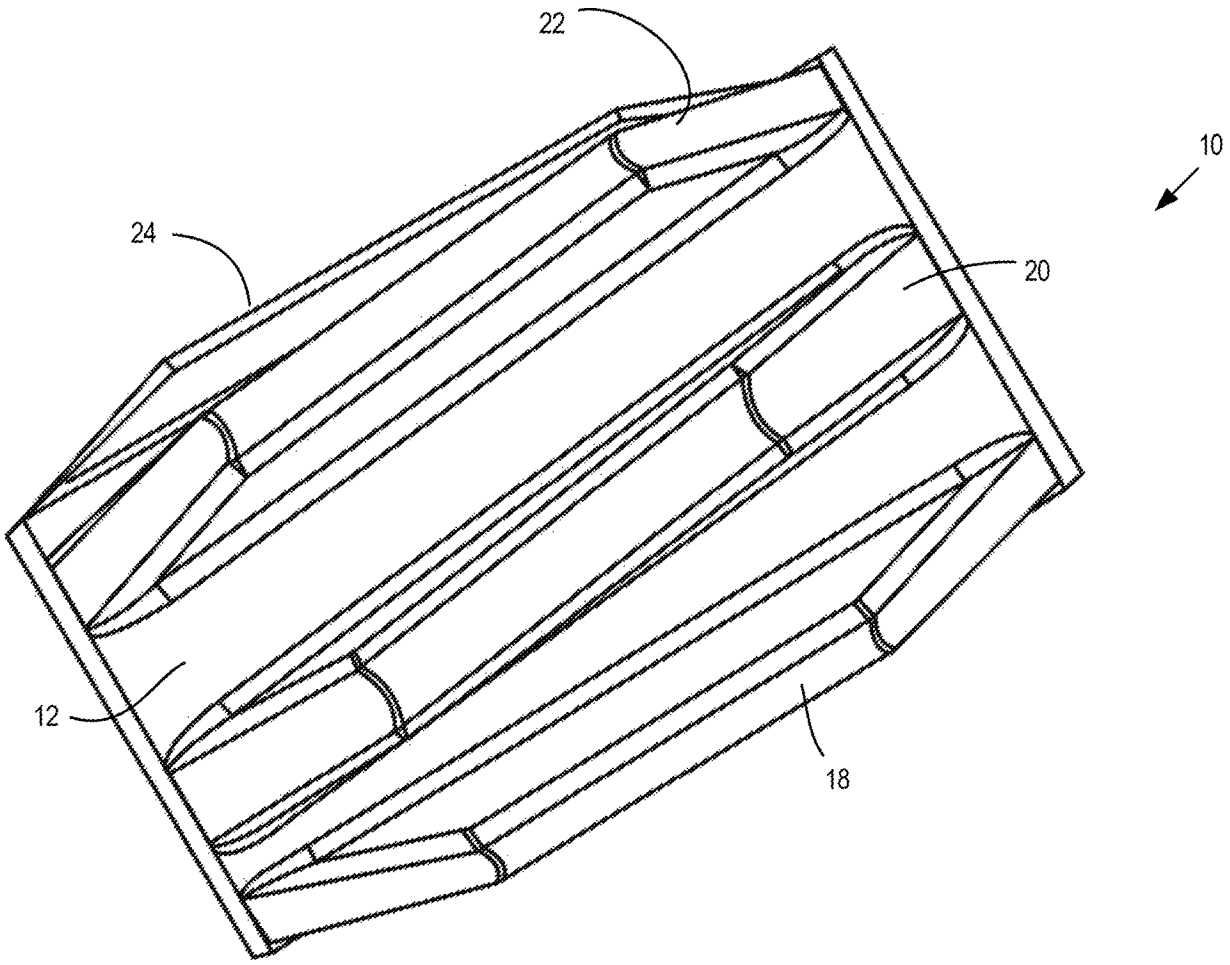
Figure 12:
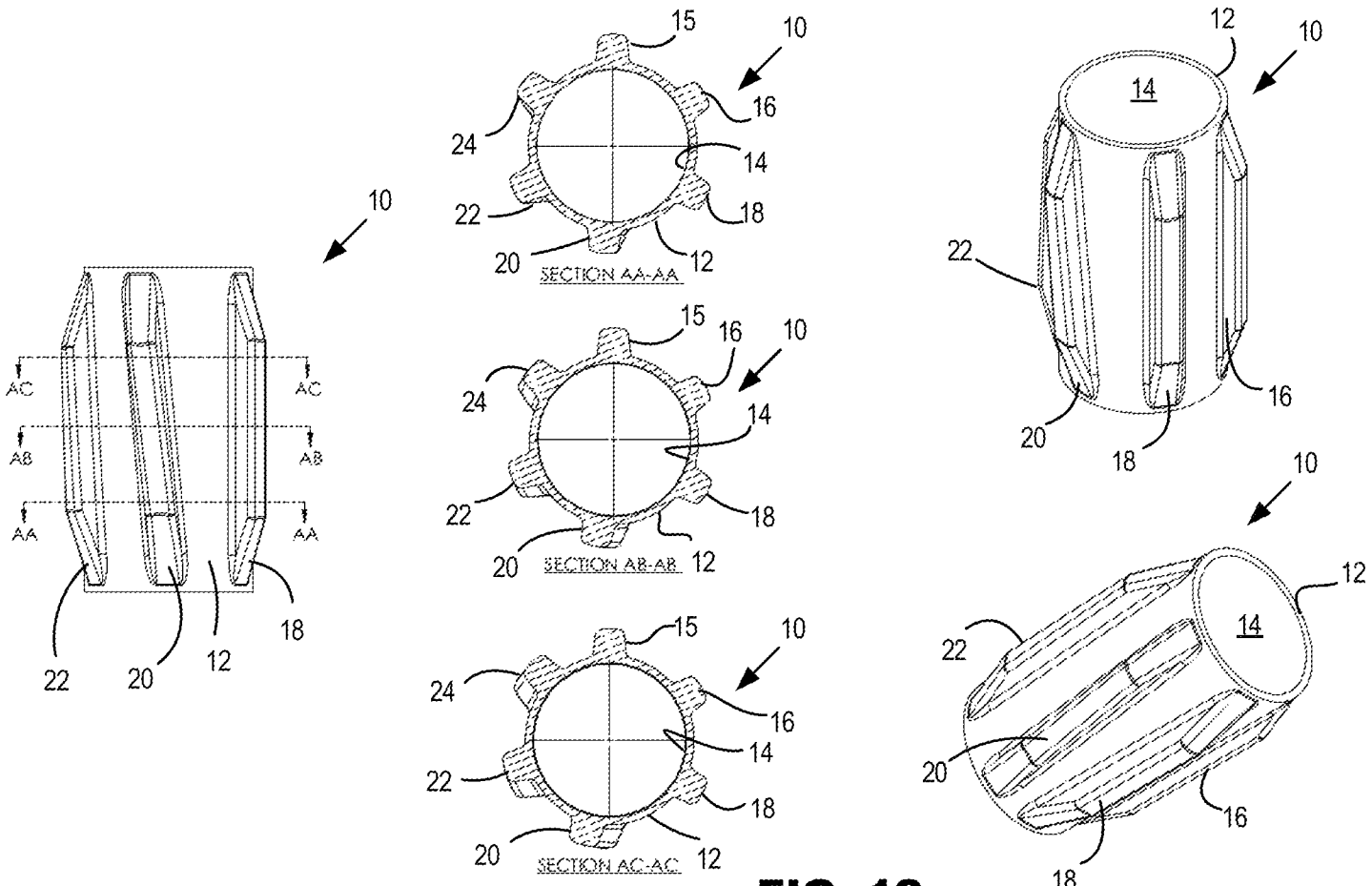
Figure 13:
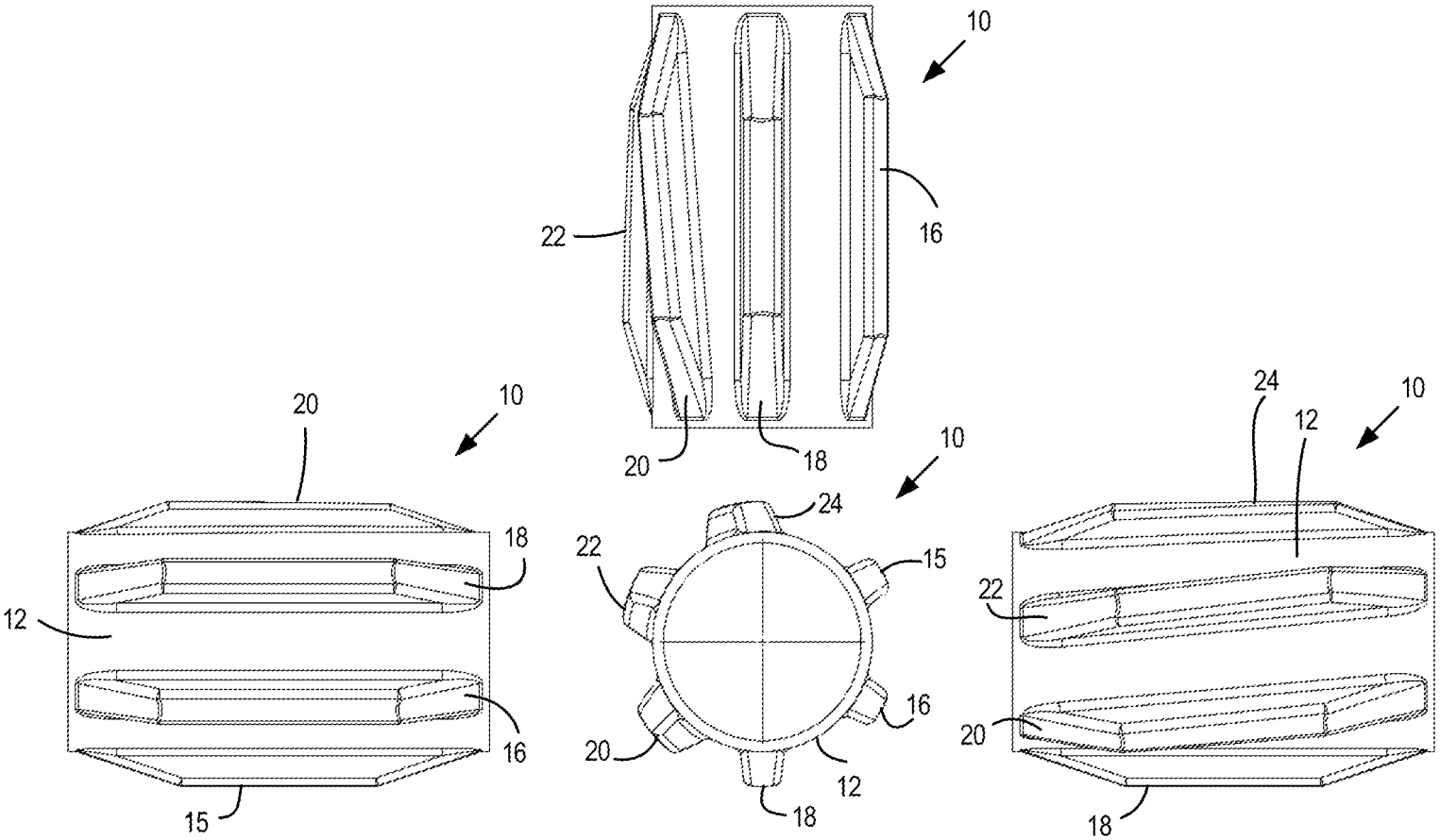

In an exemplary embodiment, as illustrated in FIGS. 1-13, a casing centralizer is generally referred to by the reference numeral 10 and includes a tubular body 12 defining an internal passage 14 extending longitudinally (or axially) therethrough. The casing centralizer 10 includes a plurality of straight vanes (or blades), that is, straight vanes 15, 16, and 18, which are located on one circumferential section of the body 12. Each of the straight vanes 15, 16, and 18 extends along the length of the body 12 in a straight direction. The straight vanes 15, 16, and 18 are spaced circumferentially about the body 12. The straight vanes 15, 16, and 18 define a first contiguous circumferential section about the body 12. In an exemplary embodiment, this first contiguous circumferential section extends circumferentially from the straight vane 15 to the straight vane 18. The casing centralizer 10 further includes a plurality of spiral vanes (or blades), that is, spiral vanes 20, 22, and 24, which are located on another circumferential section of the body 12. Each of the spiral vanes 20, 22, and 24 extends spirally and longitudinally along the length of the body 12. The spiral vanes 20, 22, and 24 are spaced circumferentially about the body 12. The spiral vanes 20, 22, and 24 define a second contiguous circumferential section about the body 12. In an exemplary embodiment, this second contiguous circumferential section extends circumferentially from the spiral vane 20 to the spiral vane 24. In an exemplary embodiment, this second contiguous circumferential section is separate from the first contiguous circumferential section.

In an exemplary embodiment, the spiral vanes 20, 22, and 24 are left hand vanes (or blades). In an exemplary embodiment, the spiral vanes 20, 22, and 24 are right hand vanes (or blades).

In an exemplary embodiment, the spiral vanes 20, 22, and 24 define a first flow resistance across the length of the body 12 and at a circumferential location with the first contiguous circumferential section (e.g., along a straight line that runs the length of the body 12 and is generally positioned between the spiral vanes 20 and 22, or along another straight line that runs the length of the body 12 and is generally positioned between the spiral vanes 22 and 24). In an exemplary embodiment, the straight vanes 15, 16, and 18 define a second flow resistance across the length of the body 12 and at a circumferential location with the second contiguous circumferential section (e.g., along a straight line that runs the length of the body 12 and is positioned between the straight vanes 15 and 16, along another straight line that runs the length of the body 12 and is positioned between the spiral vanes 22 and 24, or along a straight line that runs the length of the body 12 and along any one of the straight vanes 15, 16, and 18). The second flow resistance defined by the straight vanes 15, 16, and 18 is less than the first flow resistance defined by the spiral vanes 20, 22, and 24. The spiral vanes 20, 22, and 24 are more resistant to fluid flow therethrough.

Figure 14:
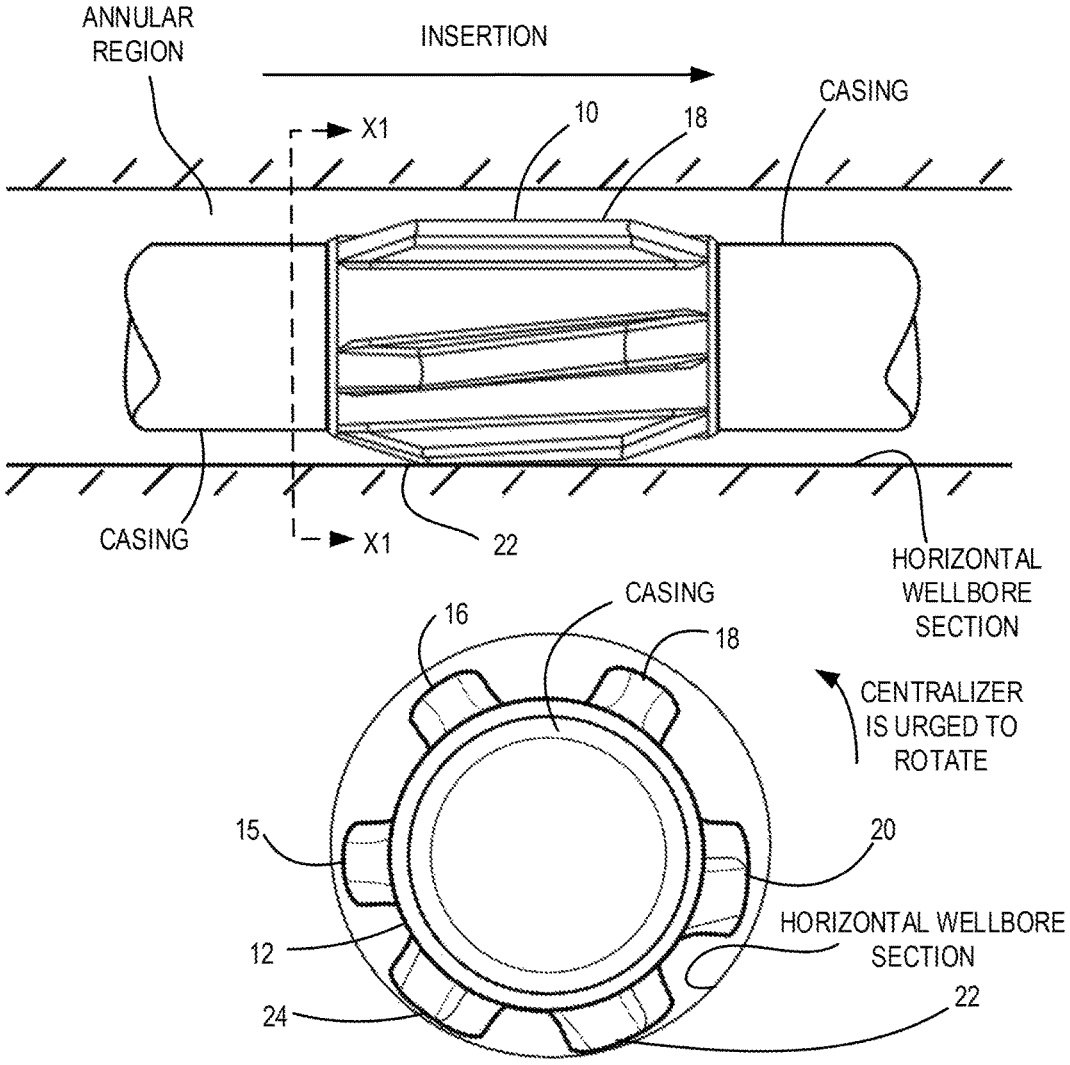
FIGS. 14 and 15 include views of the casing centralizer of FIGS. 1-13 during insertion thereof into the wellbore and subsequent operation therewithin, according to an exemplary embodiment of the present disclosure.
Figure 15:
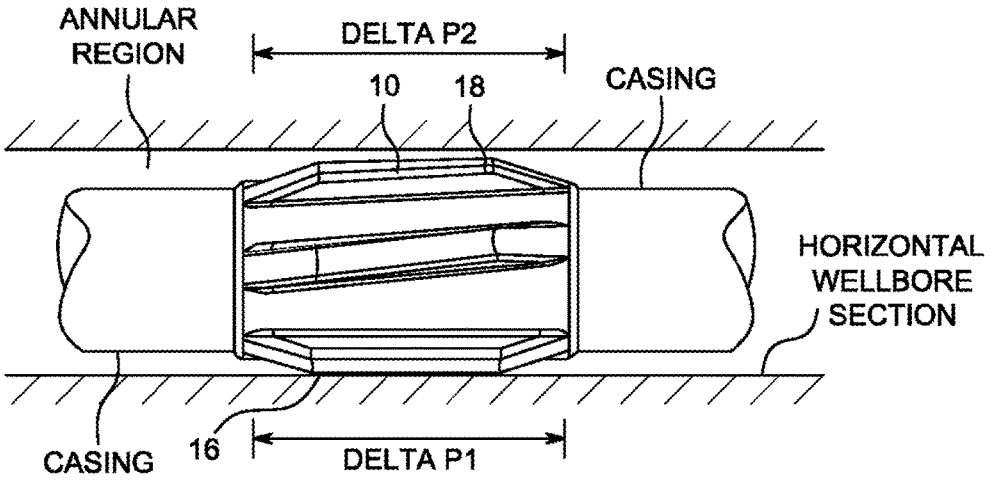
Figure 15:
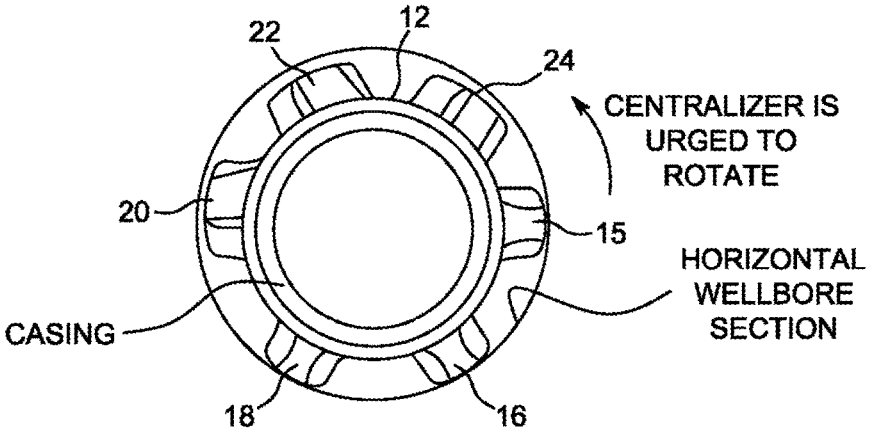

Referring to FIGS. 14 and 15 with continuing reference to FIGS. 1-13, in an exemplary embodiment, in operation, the casing centralizer 10 is inserted over a tubular, which is, or will be, part of a tubular string or casing. As a result, the casing extends through the internal passage 14 of the casing centralizer 10. The tubular string or casing is inserted into a wellbore used in oil and gas exploration and production operations. As a result, the casing centralizer 10 is also inserted into the wellbore.

With continuing reference to FIGS. 1-15, in an exemplary embodiment, the casing centralizer 10 and the tubular string or casing is inserted into a horizontal section of the wellbore. During the insertion of the casing in the horizontal wellbore section, the spiral vanes 20, 22, and 24 engage the wall of the wellbore and/or other debris, urging the casing centralizer 10 to rotate about, and relative to, the tubular string or casing. The casing centralizer 10 continues to so rotate, until the straight vanes 15, 16, and 18 are adjacent the bottom half of the horizontal wellbore wall, with the straight vane 16 being located at, or near, the bottommost area of the horizontal wellbore wall. At this point, the casing centralizer is no longer urged to rotate during installation. Thus, the casing centralizer 10 self-aligns within the horizontal wellbore section during the insertion of the tubular string or casing within the horizontal wellbore section so that the pressure drop longitudinally across the casing centralizer 10 at the bottom of the horizontal wellbore wall {Delta P1) is less than the pressure drop longitudinally across the casing centralizer 10 at the top of the horizontal wellbore wall (Delta P2) (Delta P1<Delta P2). Delta P1 is less than Delta P2 because the second flow resistance, which is defined by the straight vanes 15, 16, and 18, is less than the first flow resistance defined by the spiral vanes 20, 22, and 24.

After the tubular string or casing has been fully inserted in the horizontal wellbore section, a cementing operation is initiated, which results in cement flowing in the annular region defined between the casing and wall of the wellbore. The pressure drop longitudinally across the casing centralizer 10 at the bottom of the horizontal wellbore wall (Delta P1) is less than the pressure drop longitudinally across the casing centralizer 10 at the top of the horizontal wellbore wall (Delta P2). That is, the spiral vanes 20, 22, and 24 result in a relatively larger pressure drop across the top circumferential half of the casing centralizer 10 (or other section that may be greater or less than half). And the straight vanes 15, 16, and 18 result in a relatively smaller pressure drop across the bottom circumferential half (or other section that may be greater or less than half) of the casing centralizer 10. This counteracts the effects of gravity and the settling of the casing centralizer 10 against the bottom of the wellbore wall. This reduces the maldistribution of flowing cement within the annular region defined between the outside of the casing and the wellbore wall, thereby facilitating the distribution of the cement flow in the annular region.

In an exemplary embodiment, the casing centralizer 10 has an azimuthally decreasing axial (or longitudinal) pressure gradient from the top (at the spiral vane 22 or thereabout, that is, at the 12 o'clock position within the horizontal wellbore section) to the bottom (at the straight vane 16 or thereabout, that is, at the 6 o'clock position within the horizontal wellbore section); this azimuthally decreasing axial pressure gradient, from the top to the bottom, increases fluid velocity in the narrow annular gap between the centralizer 10 and the lower half of the horizontal wellbore section.

In an exemplary embodiment, the spiral vane 22 (the middle spiral vane) overlaps with each of the spiral vanes 20 and 24 (the outer two spiral vanes). The above-described configuration creates at least three axial pressure gradients (or three pressure drops across the longitudinal length of the centralizer 10), namely a first axial pressure gradient longitudinally or axially along the top of the centralizer 10, a second axial pressure gradient longitudinally or axially along the sides of the centralizer 10, and a third axial pressure gradient longitudinally or axially along the bottom of the centralizer 10; wherein the first axial pressure gradient is greater than the second axial pressure gradient, which, in turn, is greater than the third axial pressure gradient.

In an exemplary embodiment, before, during or after the centralizer 10 has been inserted in the wellbore, the centralizer 10 operates to center, or centralize; the casing within the wellbore in order to, for example, facilitate the insertion of the cement in the annular region defined between the outside surface of the casing and the wellbore. In an exemplary embodiment, one or more of the straight vanes 15, 16, and 18 prevent the casing from contacting the wall of the wellbore. In an exemplary embodiment, one or more of the straight vanes 15, 16, and 18, and one or more of the spiral vanes 20, 22, and 24, prevent the casing from contacting the wall of the wellbore.

In an exemplary embodiment, the respective radial heights of the straight vanes 15, 16, and 18 are all equal. In an exemplary embodiment, the respective radial heights of the spiral vanes 20, 22, and 24 are all equal. In an exemplary embodiment, the respective radial heights of the straight vanes 15, 16, and 18, and the spiral vanes 20, 22, and 24, are all equal. The radial height of each vane is measured radially from the center of the internal passage 14, or radially from the outer surface of the body 12.

Alternatively, in several exemplary embodiments, to promote rotation of the casing centralizer 10 during the insertion thereof, one or more of the spiral vanes 20, 22, and 24 have varying radial heights {i.e., one or more of the spiral vanes 20, 22, and 24 are taller than one or more of the other spiral vanes 20, 22, and 24). In several exemplary embodiments, to facilitate stopping the rotation of the centralizer 10 so that the straight vanes 15, 16, and 18 are positioned below the spiral vanes 20, 22, and 24 within the horizontal wellbore section, one or more of the straight vanes 15, 16, and 18 have varying radial heights (i.e., one or more of the straight vanes 15, 16, and 18 are taller than one or more of the other straight vanes 15, 16, and 18).

Figure 16:
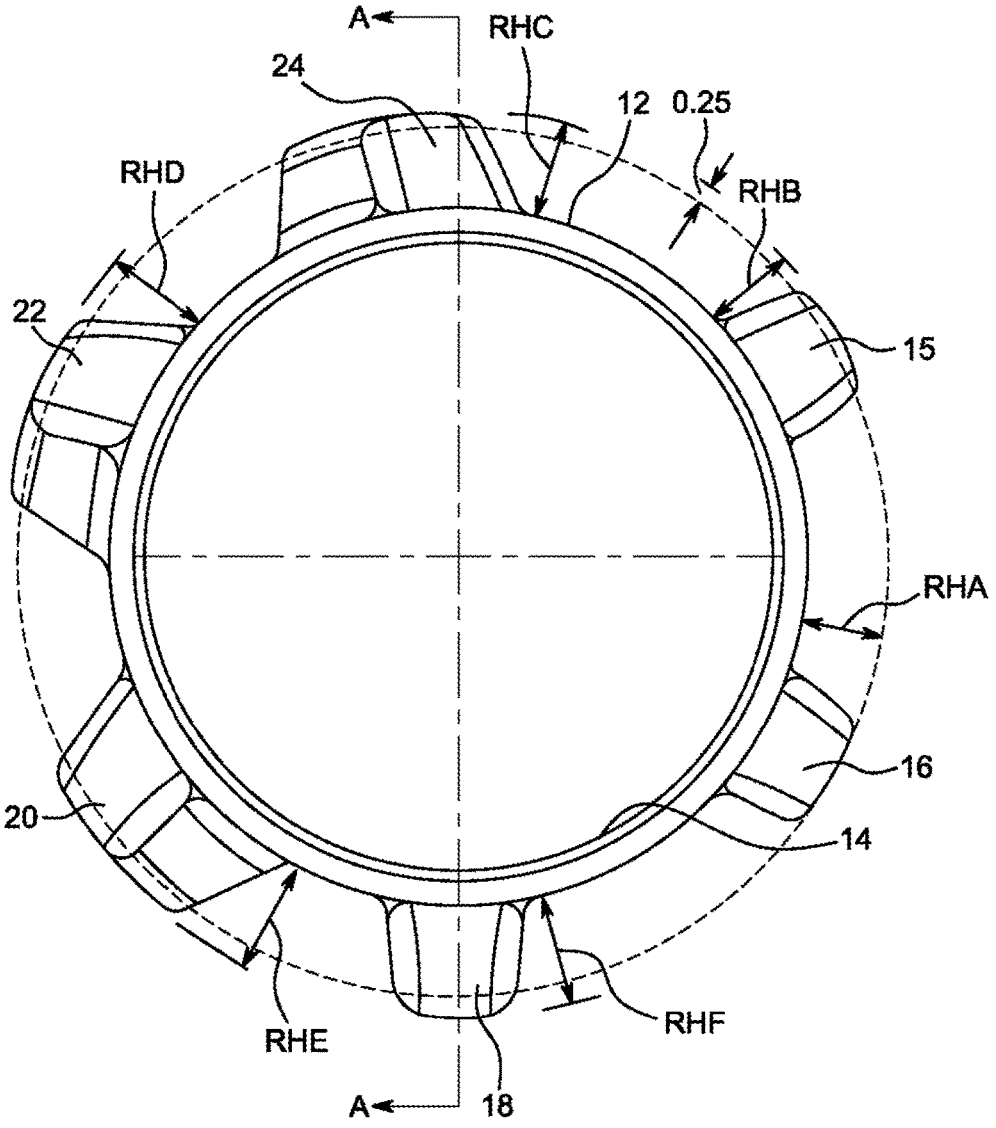
FIGS. 16 and 17 include views of a casing centralizer, according to another exemplary embodiment of the present disclosure.
Figure 17:
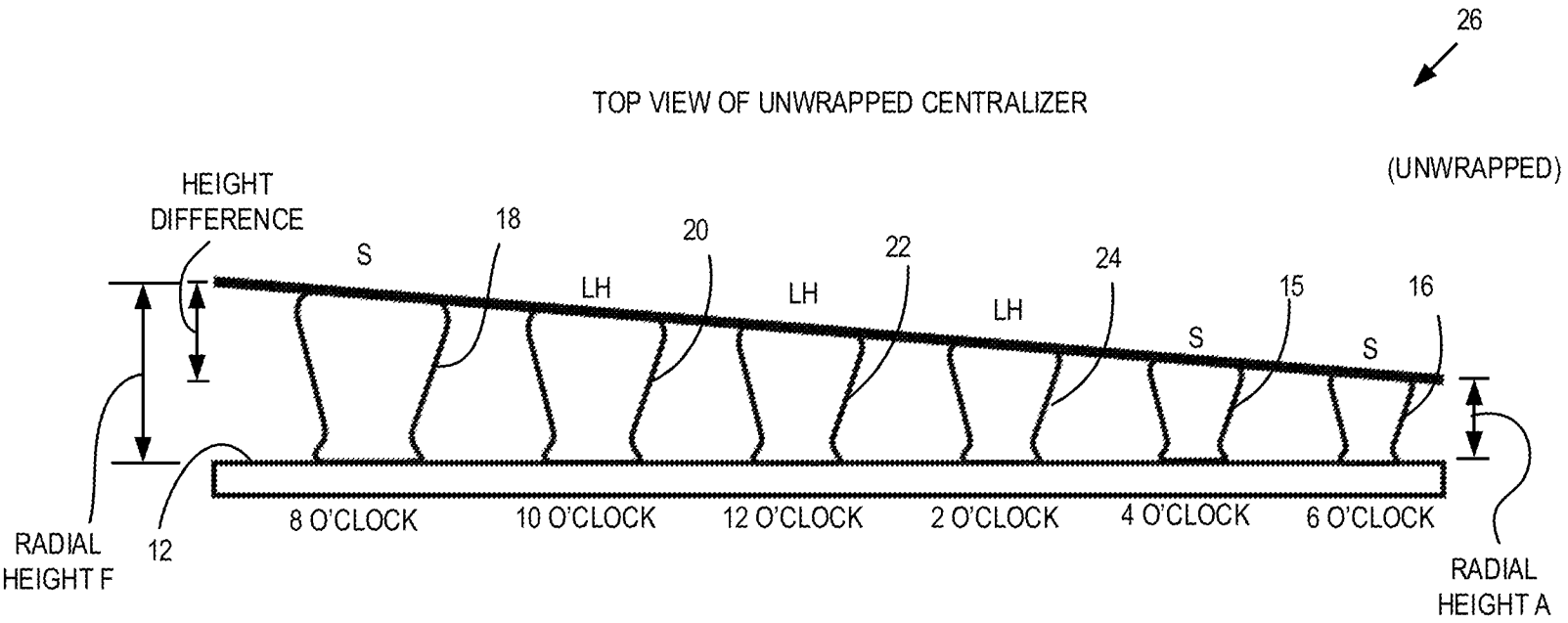

For example, in an exemplary embodiment, as illustrated in FIGS. 16 and 17 with continuing reference to FIGS. 1-15, a casing centralizer is generally referred to by the reference numeral 26 and includes all of the components of the casing centralizer 10, which components are given the same reference numerals. In the casing centralizer 26 illustrated in FIGS. 16 and 17, vane {or blade) height decreases in one direction to urge rotation. The straight vane 16 is the shortest vane, and the straight vane 18 is the tallest vane. That is, the straight vane 16 has the lowest radial height, and the straight vane 18 has the highest radial height; in an exemplary embodiment, the difference between the two is about ¼-inch. In an exemplary embodiment, the difference is a dimension other than about ¼-inch. The straight vane 15 is taller than the straight vane 16, the spiral vane 24 is taller than the straight vane 15, the spiral vane 18 is taller than the spiral vane 24, the spiral vane 20 is taller than the spiral vane 22, and the straight vane 24 is taller than the spiral vane 22. The radial height of each vane is measured radially from the center of the internal passage 14, or radially from the outer surface of the body 12. In an exemplary embodiment, the spiral vanes 20, 22, and 24 are left hand blades. The left hand spiral and the varying radial height of the vanes create a tendency for the centralizer 26 to rotate counterclockwise when looking down the wellbore. During insertion, the foregoing varying radial heights induce instability and urge rotation, causing the centralizer 26 to rotate until it has reached the only stable position possible; at this stable position, the straight vane 16 is the lowermost vane in the horizontal wellbore section, and the spiral vane 22 is the uppermost vane in the horizontal wellbore section. The shortest straight vane, that is, the straight vane 16, creates, or at least contributes to, stability. In several exemplary embodiments, the insertion and operation of the centralizer 26 is identical to that of the centralizer 10.

Figure 18:
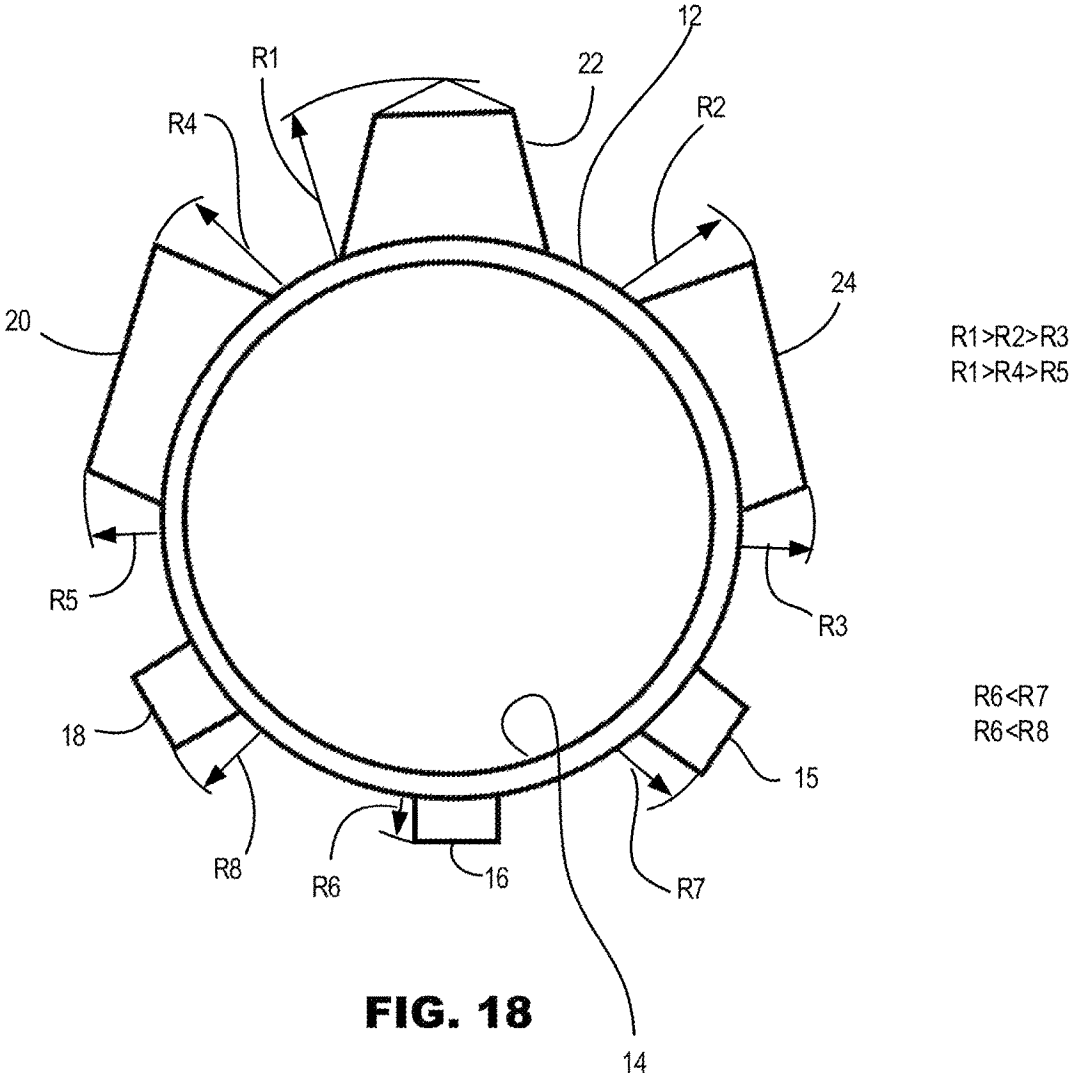
FIG. 18 is a view of a casing centralizer, according to yet another exemplary embodiment of the present disclosure.
Figure 19:
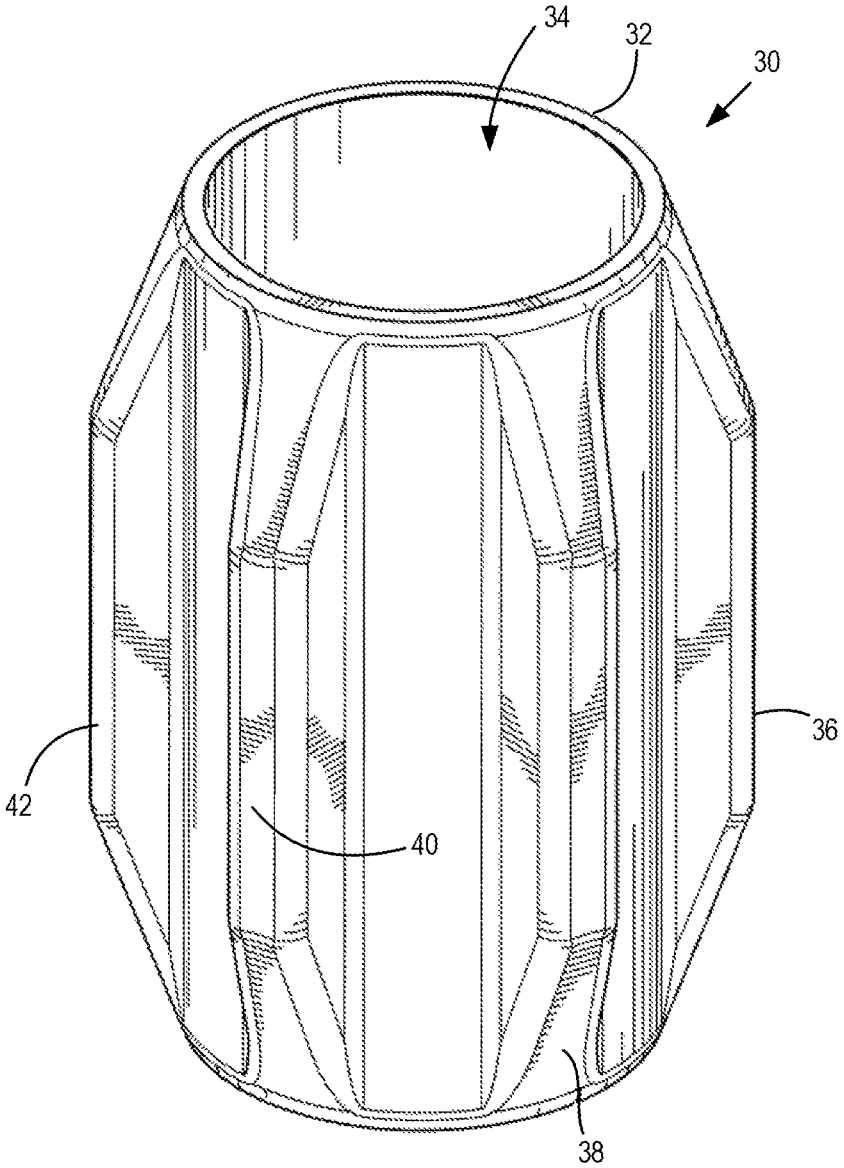
FIGS. 19-22 include views of a casing centralizer, according to still yet another exemplary embodiment of the present disclosure.

In an exemplary embodiment, as illustrated in FIG. 18 with continuing reference to FIGS. 1-17, a casing centralizer is generally referred to by the reference numeral 28 and includes all of the components of the casing centralizer 10, which components are given the same reference numerals. In the casing centralizer 28 illustrated in FIG. 18, the middle of the cross section of the spiral vane 22 has a radial height that is slightly greater than the respective radial heights of the spiral vanes 20 and 24. The side of the spiral vane 24 that is closer to the spiral vane 22 has a radial height that is greater than the opposing side of the spiral vane 24 that is farther from the spiral vane 22. Likewise, the side of the spiral vane 20 that is closer to the spiral vane 22 has a radial height that is greater than the opposing side of the spiral vane 20 that is farther from the spiral vane 22. The foregoing radial heights, and the relative variances among the radial heights, form a rooftop profile. Additionally, as shown in FIG. 18, the straight vane 16 has a radial height that is less than the respective radial heights of the straight vanes 15 and 18. During insertion, the foregoing varying radial heights induce instability and urge rotation, causing the centralizer 28 to rotate until it has reached the only stable position possible, which is shown in FIG. 18. At this point, the straight vane 16 is the lowermost vane in the horizontal wellbore section, and the spiral vane 22 is the uppermost vane in the horizontal wellbore section.

In several exemplary embodiments, the insertion and operation of the centralizer 28 is identical to that of the centralizer 10.

Figure 21:
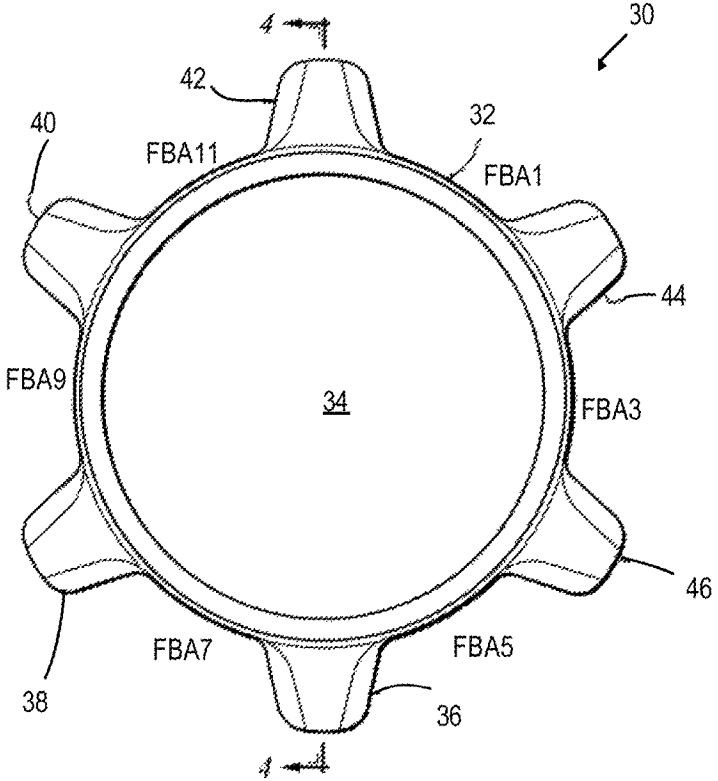
Figure 20:
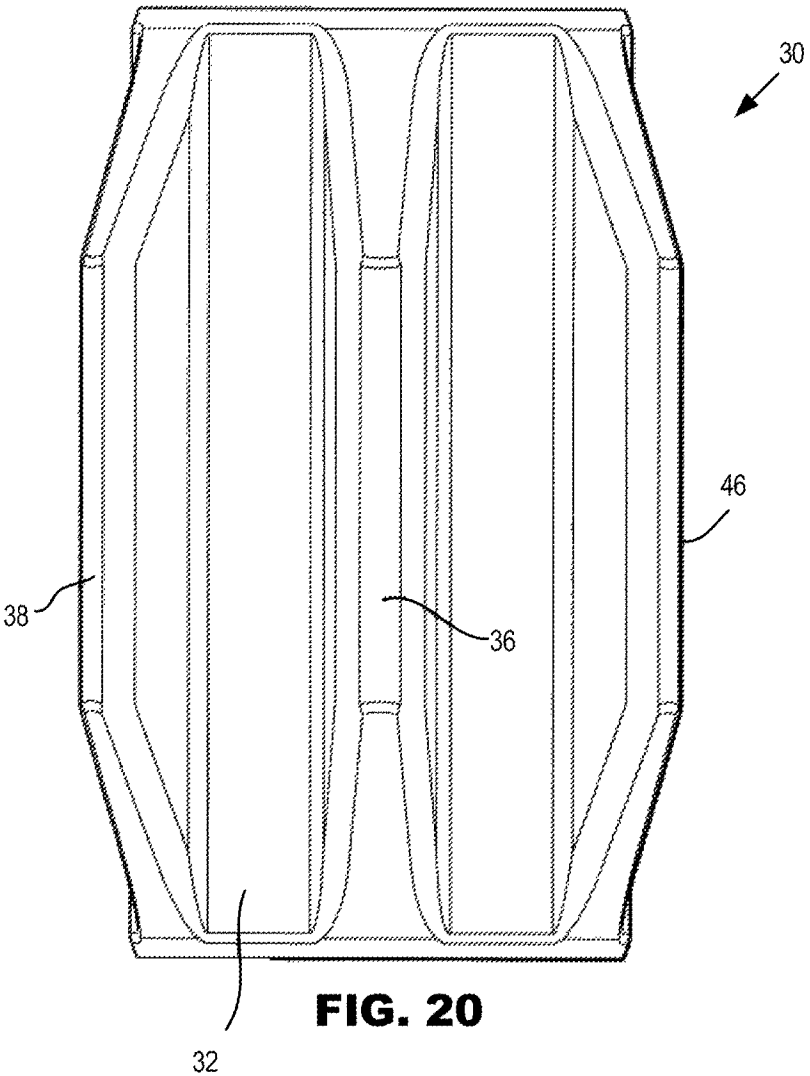
Figure 22:
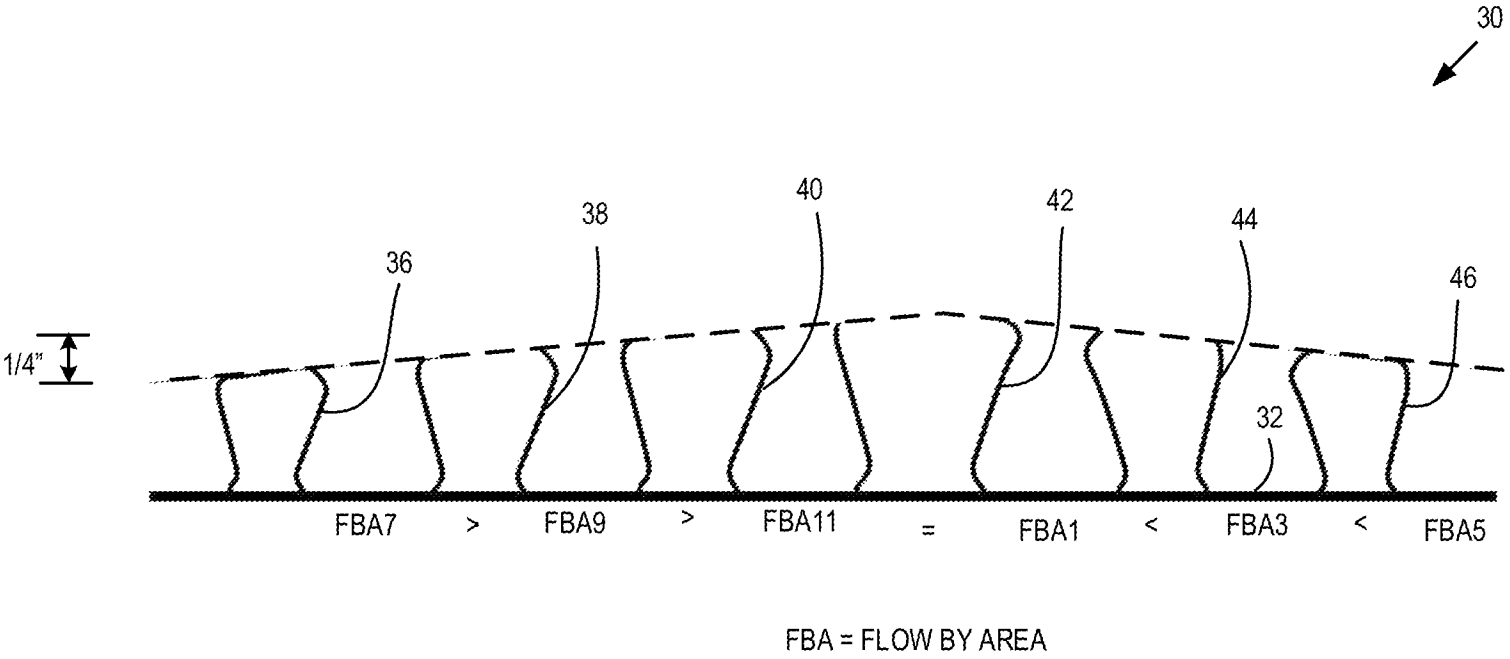
Figure 23:
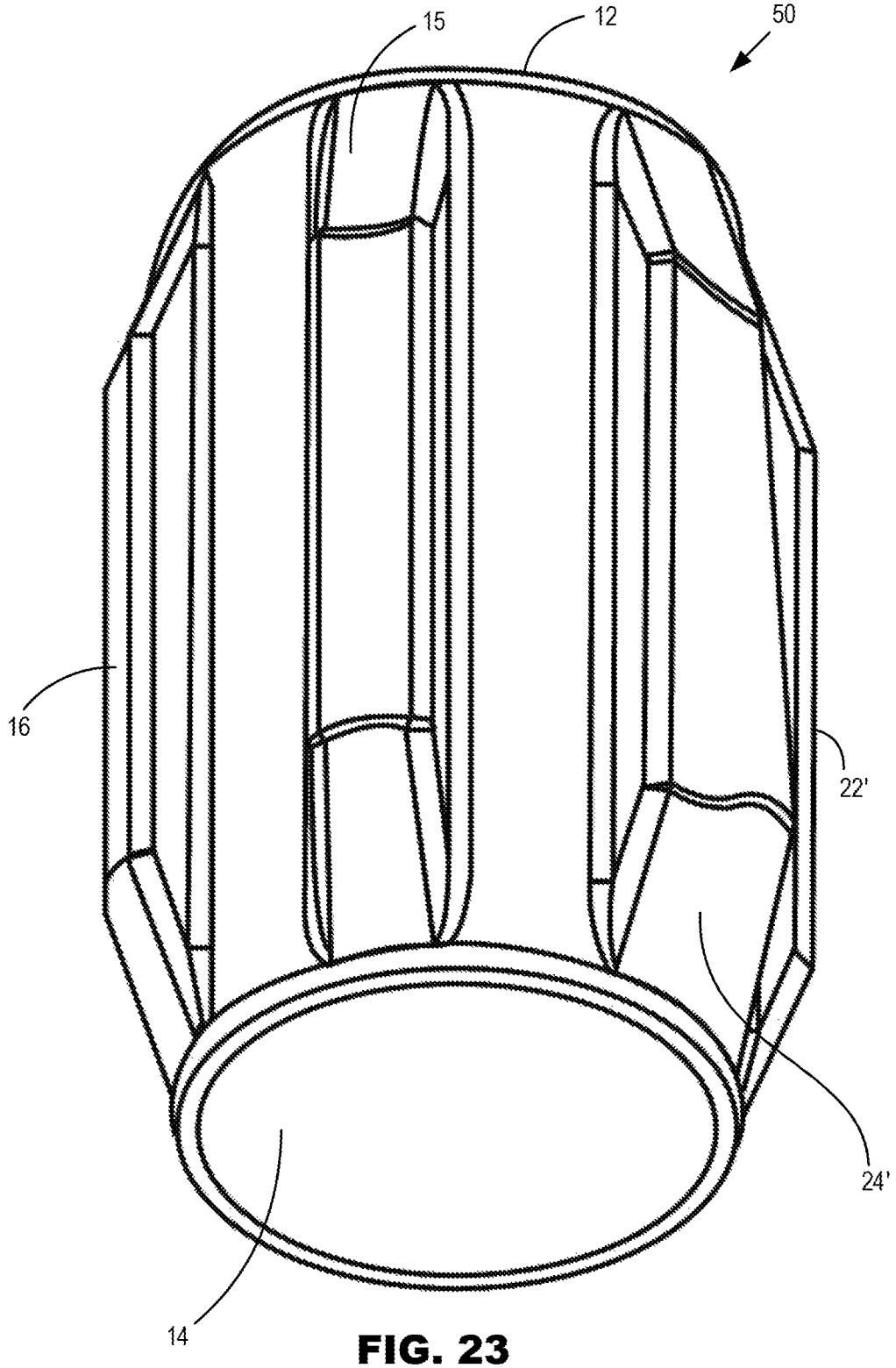
FIGS. 23-30 include views of a casing centralizer, according to still yet another exemplary embodiment of the present disclosure.
Figure 24:
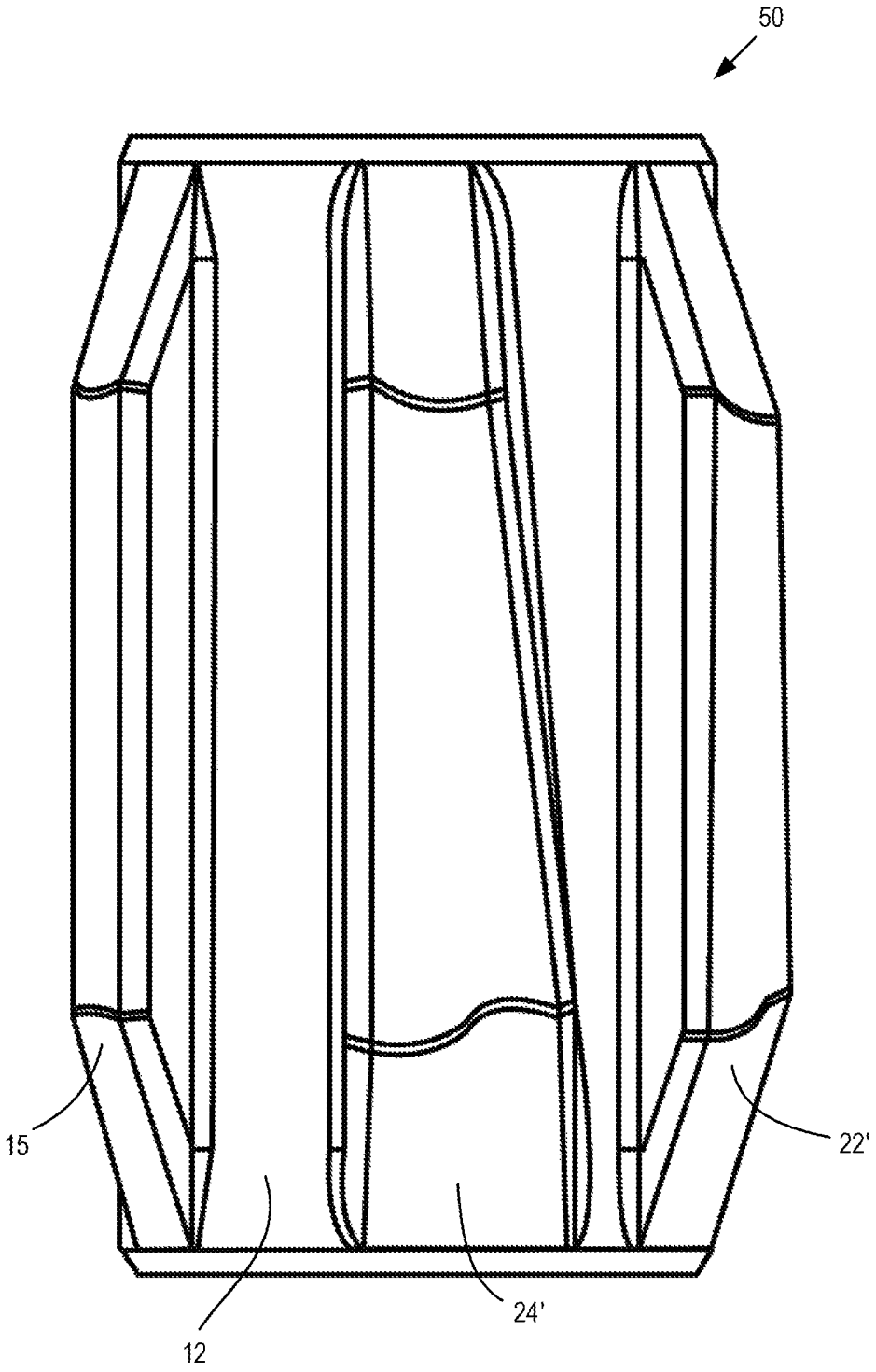
Figure 25:
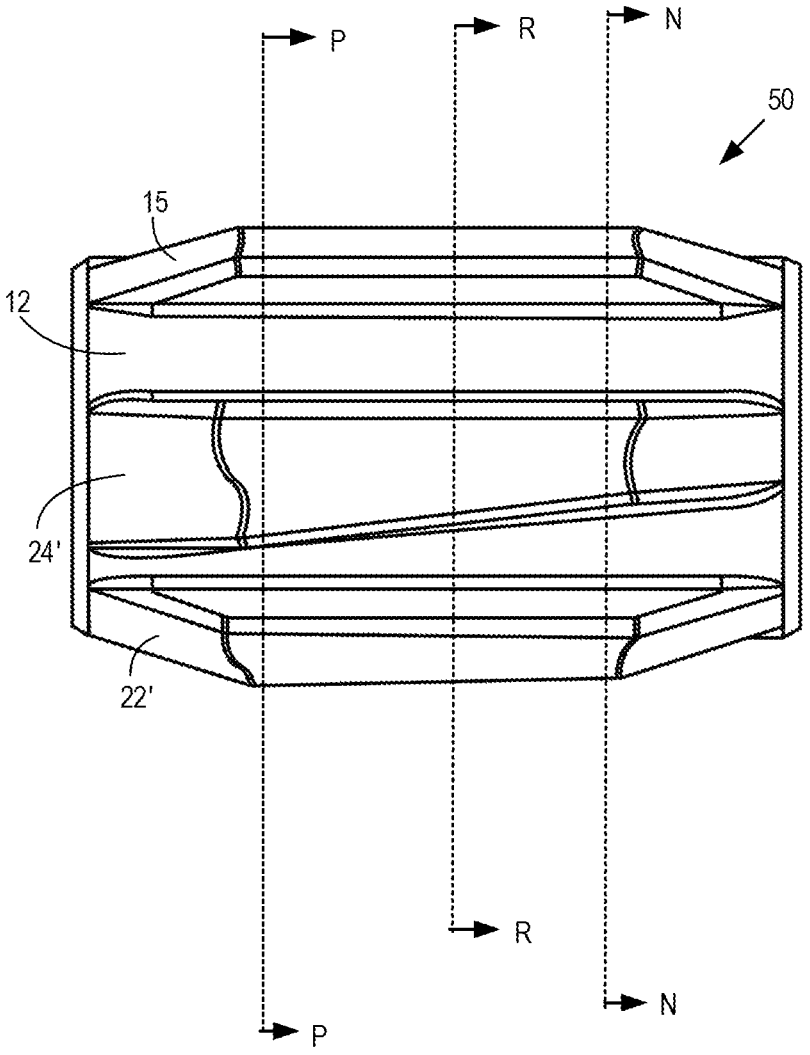
Figure 26:
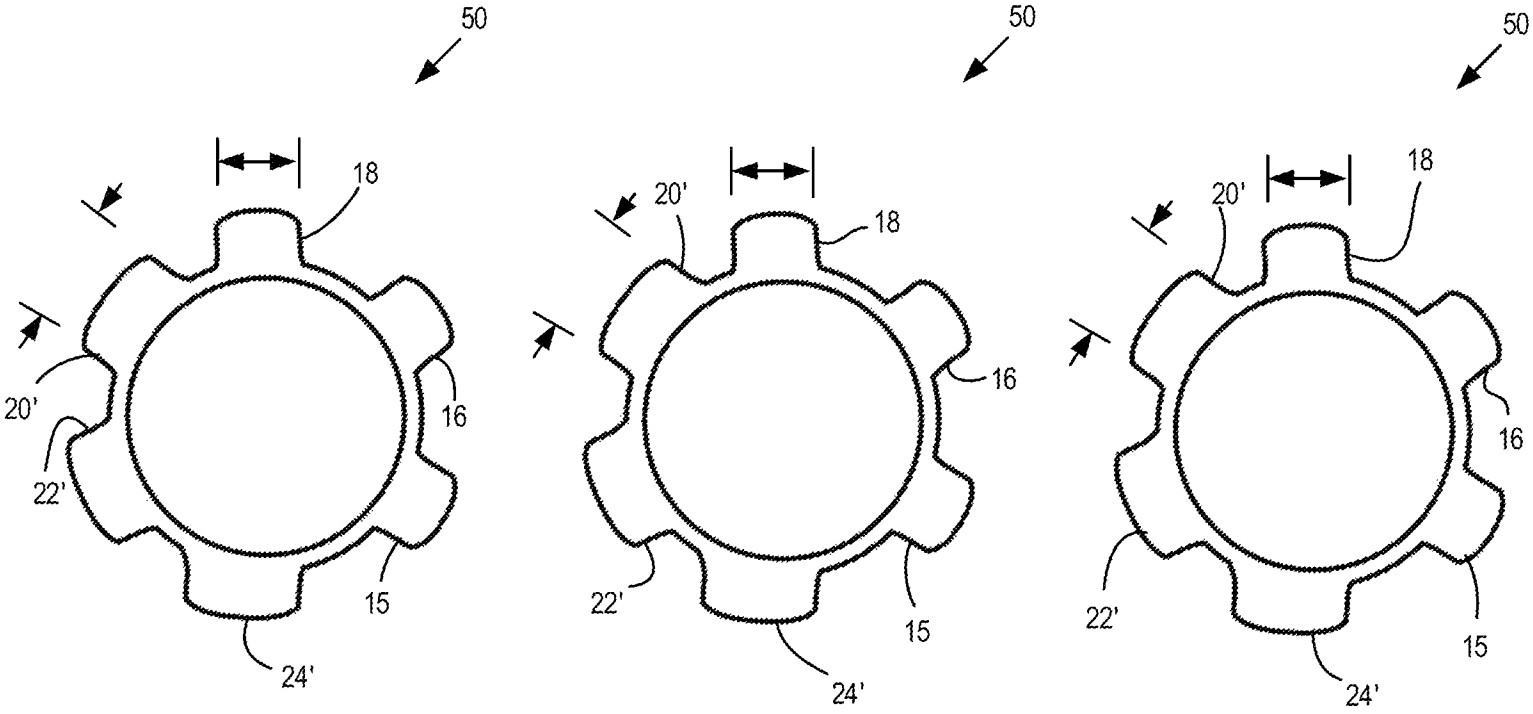
Figure 27:
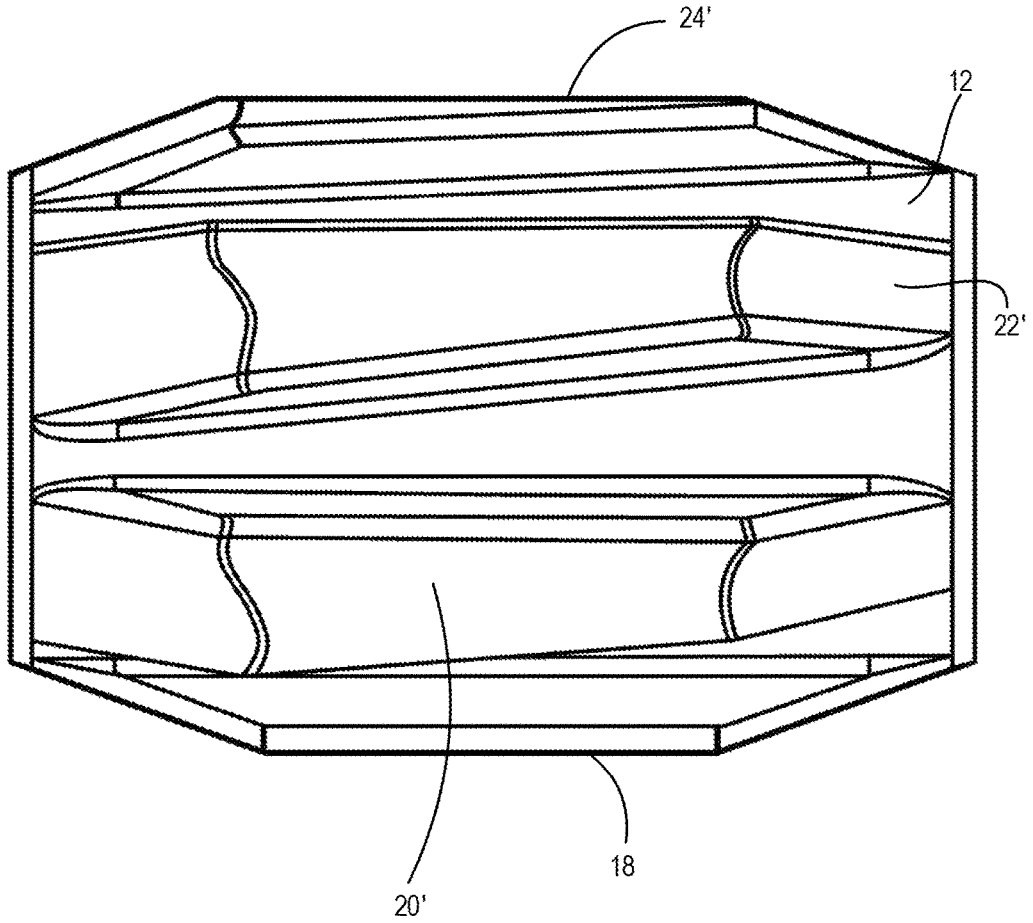
Figure 28:
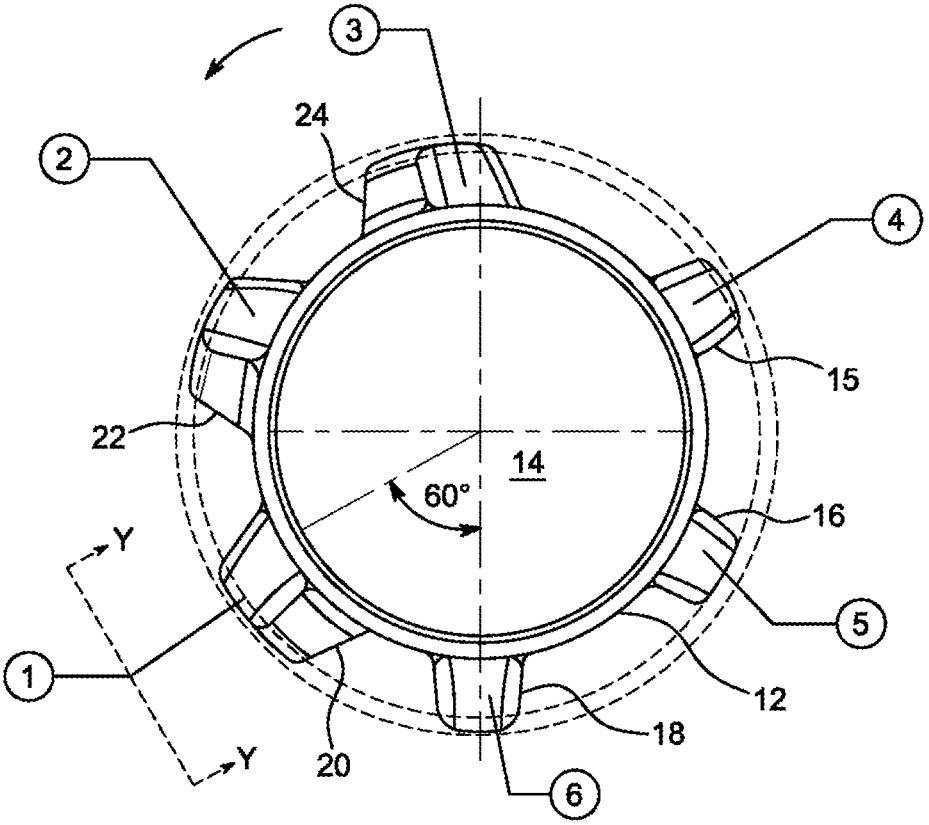
Figure 29:
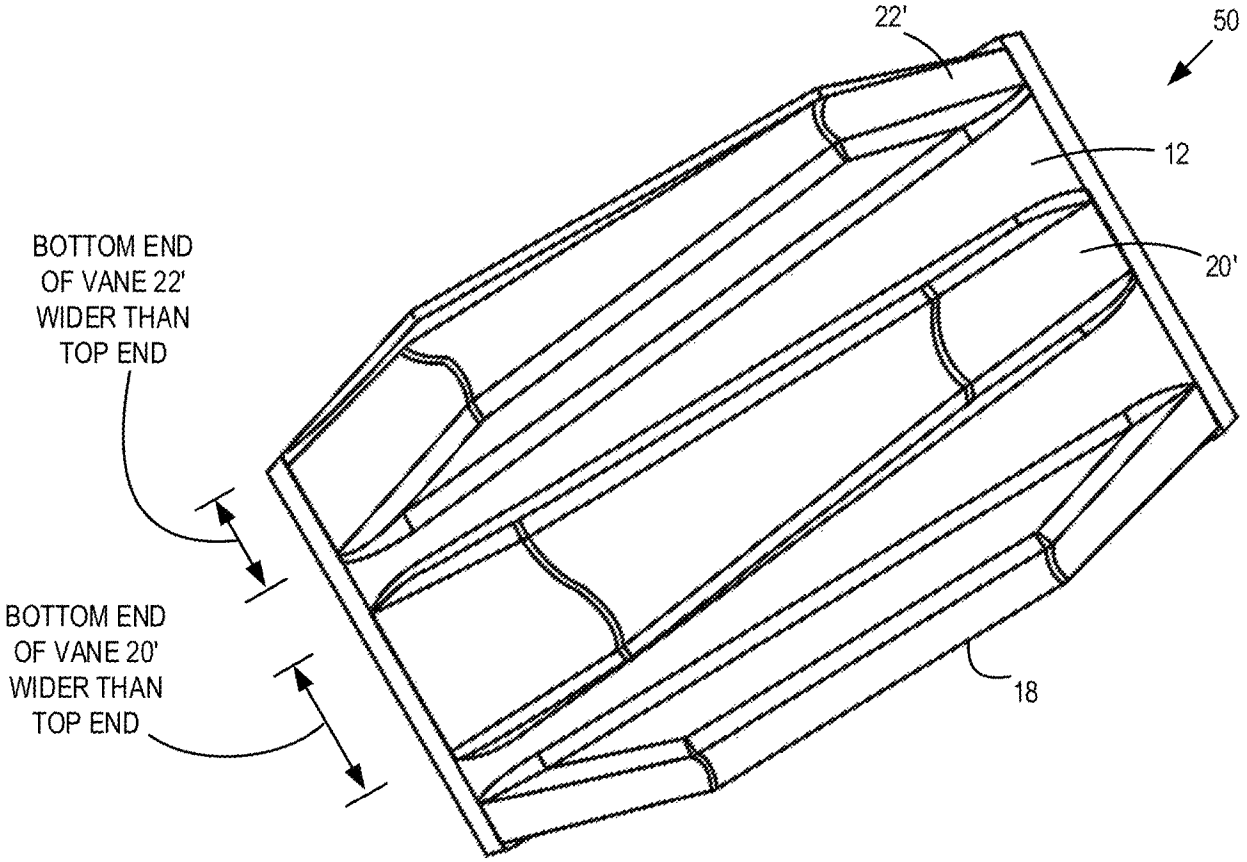
Figure 30:
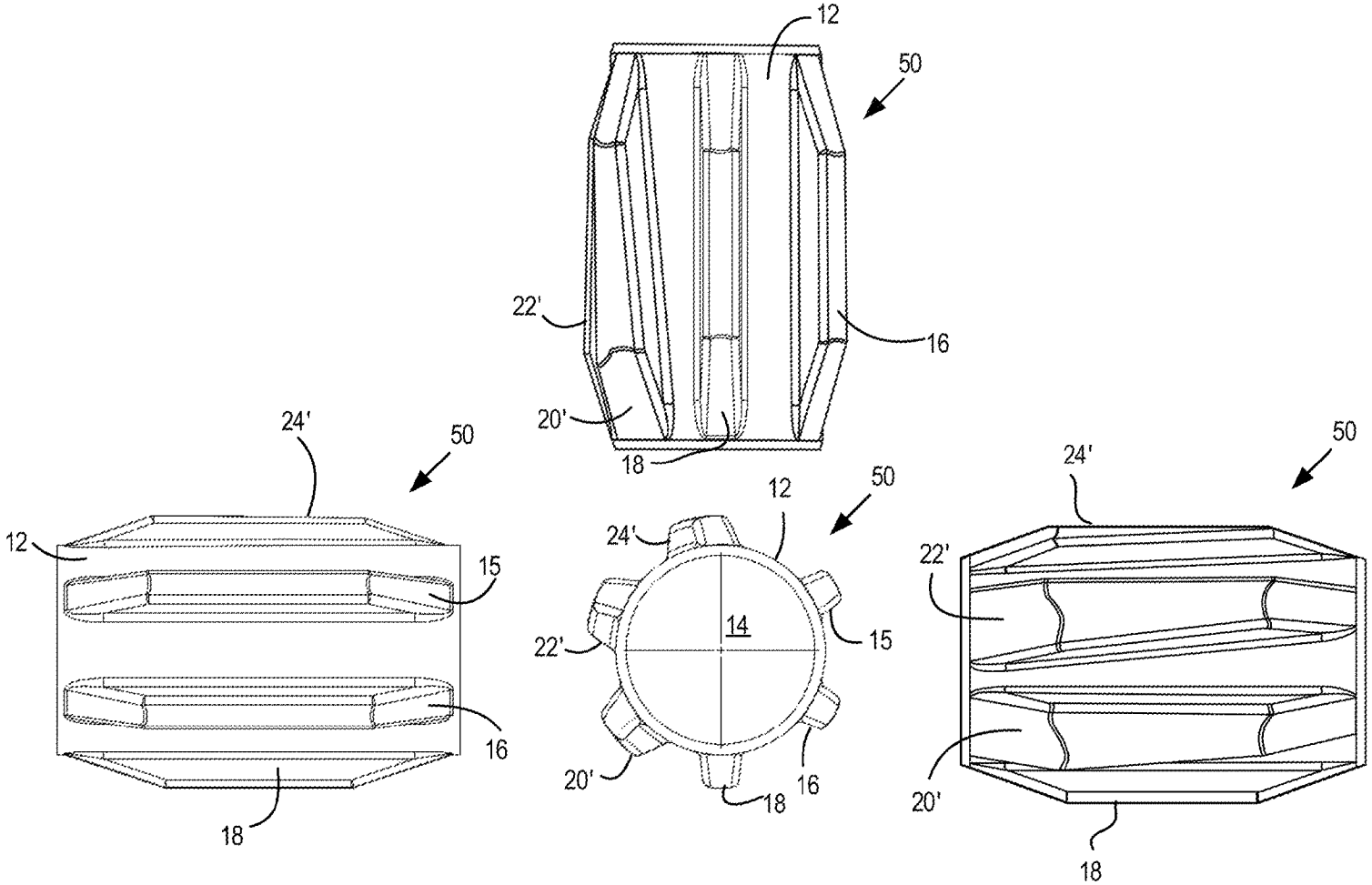

In an exemplary embodiment, as illustrated in FIGS. 19-22 with continuing reference to FIGS. 1-18, a casing centralizer is generally referred to by the reference numeral 30 and includes a tubular body 32 defining an internal passage 34 extending longitudinally therethrough. The casing centralizer 30 includes a plurality of straight vanes (or blades), that is, straight vanes 36, 38, 40, 42, 44, and 46, each of which extends along the length of the body 32 in a straight direction. The straight vanes 36-46 are spaced circumferentially about the body 12. As shown in FIG. 22, the radial height of the straight vane 42 is greater than the respective radial heights of the other straight vanes, and the radial height of the straight vane 36 is less than the respective radial heights of the other straight vanes. The radial height of the straight vane 42 is greater than the radial height of the straight vane 40, which is greater than the radial height of the straight vane 38, which is greater than the radial height of the straight vane 36. The radial height of the straight vane 42 is greater than the radial height of the straight vane 44, which is greater than the radial height of the straight vane 46, which is greater than the radial height of the straight vane 36. The foregoing radial heights, and the relative variances among the radial heights, form a rooftop profile. In an exemplary embodiment, Flow-By-Area's (FBAs) are defined between respective pairs of the straight vanes, as indicated in FIGS. 21 and 22. As indicated in FIG. 22: FBA 11 equals FBA1; FBA11 is less than FBA9, which is less than FBA7; and FBA1 is less than FBA3, which is less than FBA5.

In operation, in an exemplary embodiment, when a tubular string or casing extends through the internal passage 34 and as the tubular string or casing, and thus the casing centralizer 30, are inserted into a horizontal wellbore section, the casing centralizer 30 tends to rotate in either direction (clockwise or counterclockwise) because of the reducing vane (or blade) radial height. In an exemplary embodiment, the most stable position is when the straight vane 36 (having the shortest radial height) is located at, or near, the bottommost area of the horizontal wellbore wall. At this point, the casing centralizer 30 is no longer urged to rotate during installation. Thus, the casing centralizer 30 self-aligns within the horizontal wellbore section during the insertion of the tubular string or casing within the horizontal wellbore section so that the pressure drop longitudinally across the casing centralizer 30 at the bottom of the horizontal wellbore wall (Delta P1) is less than the pressure drop longitudinally across the casing centralizer 30 at the top of the horizontal wellbore wall (Delta P2) (Delta P1<Delta P2). Delta P1 is less than Delta P2 because the flow resistance, defined by the straight vanes 46, 36, and 38, is less than the flow resistance defined by the straight vanes 40, 42, and 44 (each of FBA7 and FBA5 is greater than each of FBA11 and FBA1). This most stable position is shown in FIG. 21.

In an exemplary embodiment, as illustrated in FIGS. 23-30, a casing centralizer is generally referred to by the reference numeral 50 and includes components that are identical to the components of the casing centralizer 10, which identical components are given the same reference numerals. The casing centralizer 50 includes a plurality of spiral vanes, that is, spiral vanes 20', 22', and 24', which are identical to the spiral vanes 20, 22, and 24, respectively, of the casing centralizer 10, except that the respective bottom ends of the spiral vanes 20', 22', and 24' are wider (or circumferentially wider) than their respective top ends.

In several exemplary embodiments, the insertion and operation of the centralizer 50 is identical to that of the centralizer 10.

In an exemplary embodiment, the tubular string or casing extends through the internal passage 14 of the centralizer 50, and the casing and the centralizer 50 are inserted into the wellbore so that wider bottom ends of the spiral vanes 20', 22', and 24' are inserted into the wellbore first, before the narrower top ends of the spiral vanes 20', 22', and 24'. In an exemplary embodiment, the centralizer 50 is marked to indicate that the bottom end should be inserted into the wellbore first. In an exemplary embodiment the centralizer 50 has a "this side down" engraving or other marking.

In several exemplary embodiments, during operation, fluid flow between the spiral vanes 20' and 22' creates a jetting force so that fluid impacts the wellbore wall and better displaces gelled mud. In an exemplary embodiment, this is due, at least in part, to the wider bottom ends of the spiral vanes 20' and 22'. In several exemplary embodiments, during operation, fluid flow between the spiral vanes 22' and 24' creates a jetting force so that fluid impacts the wellbore wall and better displaces gelled mud. In an exemplary embodiment, this is due, at least in part, to the wider bottom ends of the spiral vanes 22' and 24'. In several exemplary embodiments, during operation, fluid flow between the spiral vane 20' and the straight vane 18 creates a jetting force so that fluid impacts the wellbore wall and better displaces gelled mud. In an exemplary embodiment, this is due, at least in part, to the wider bottom end of the spiral vane 20'.

In several exemplary embodiments, each of the spiral vanes 20', 22', and 24' has a tear-drop shape, with the top end thereof forming the top of the tear-drop shape and the bottom end thereof forming the relatively wider bottom of the tear-drop shape.

Figure 31:
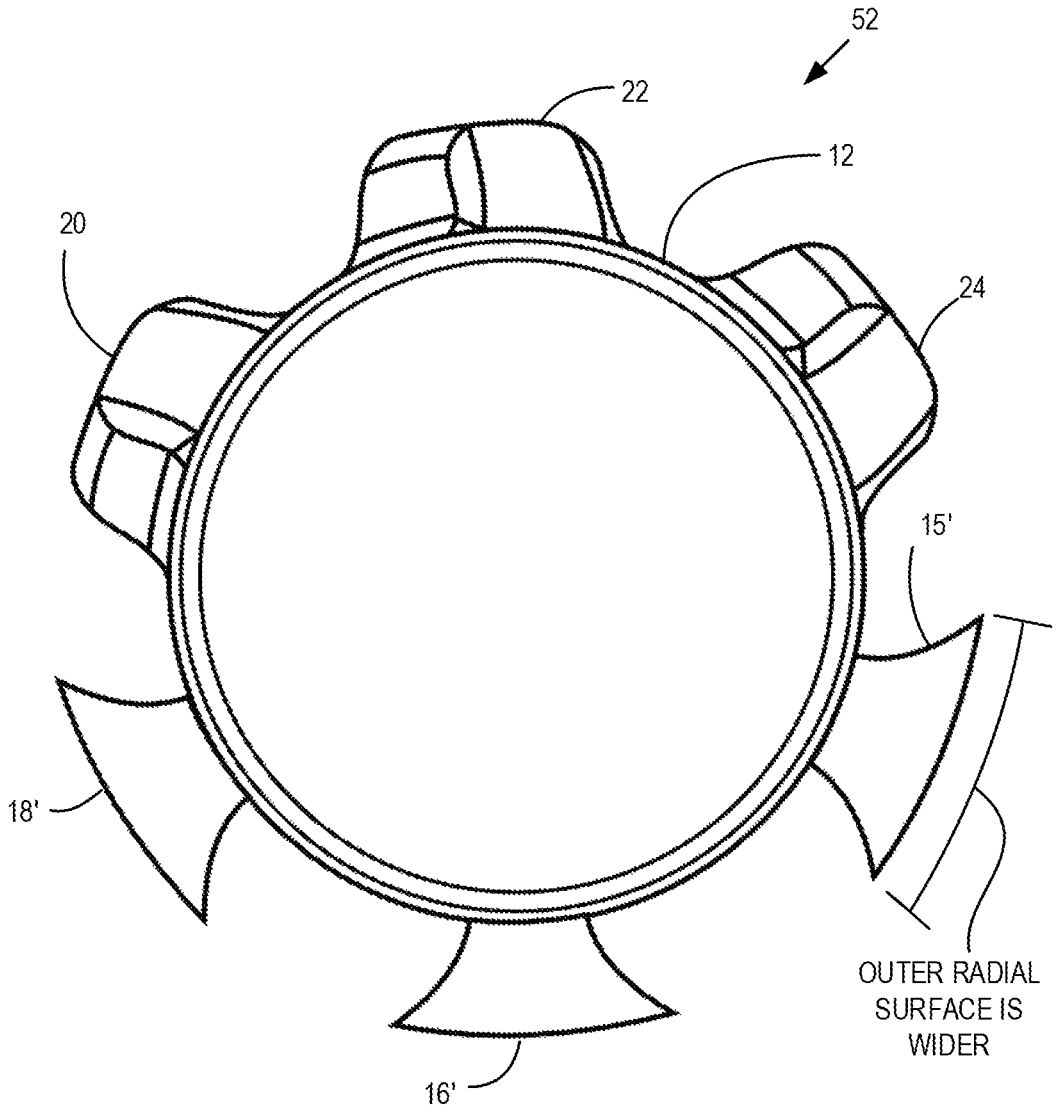
FIG. 31 is a view of a casing centralizer according to still yet another exemplary embodiment.

In an exemplary embodiment, as illustrated in FIG. 31 with continuing reference to FIGS. 1-30, a casing centralizer is generally referred to by the reference numeral 52 and includes components that are identical to the components of the casing centralizer 10, which identical components are given the same reference numerals. The casing centralizer 52 includes a plurality of straight vanes, that is, straight vanes 15', 16', and 18', which are identical to the straight vanes 15, 16, and 17, respectively, of the casing centralizer 10, except that each of the straight vanes 15', 16', and 18' is shaped so that its outer radial surface defines a larger surface area than the corresponding outermost radial surface of the straight vane 15, 16, or 18. In several exemplary embodiments, the insertion and operation of the centralizer 52 is identical to that of the centralizer 10. Additionally, however, after the centralizer 52 self-aligns and the straight vane 16' is at about the bottommost center of the horizontal wellbore section (and the straight vanes 15', 16', and 18' are positioned below the spiral vanes 20, 22, and 24), the increased surface areas of the outer radial surfaces of the straight vanes 15', 16', and 18' facilitate in preventing the centralizer 52 from sinking into the formation through which the horizontal wellbore section extends. The outer radial surfaces of the straight vanes 15', 16', and 18' operate in a manner similar to that of snow shoes, increasing the footprint of the straight vanes 15', 16', and 18'. In an exemplary embodiment, the width of each of the straight vanes 15', 16', and 18' and its connection to the body 12 is less than the width of the outer radial surface, thereby maintaining or increasing flow-by-area between the straight vanes. In an exemplary embodiment, one or more of the straight vanes 15', 16', and 18' have dove-tail-shaped cross-sections, each of which is narrower at its intersection with the body 12 and wider at its outer radial edge.

Figure 32:
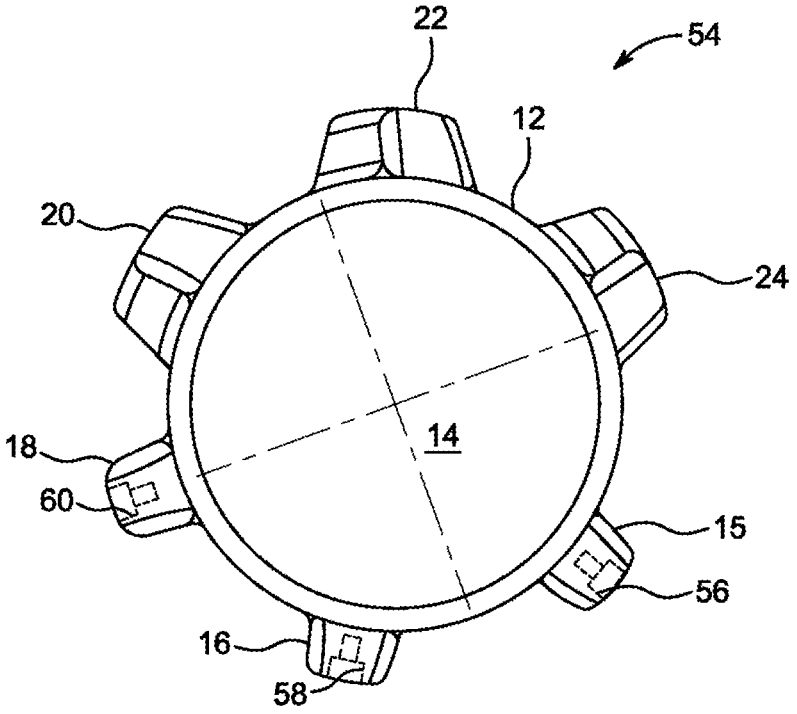
FIGS. 32 and 33 include views of a casing centralizer, according to still yet another exemplary embodiment of the present disclosure.
Figure 33:
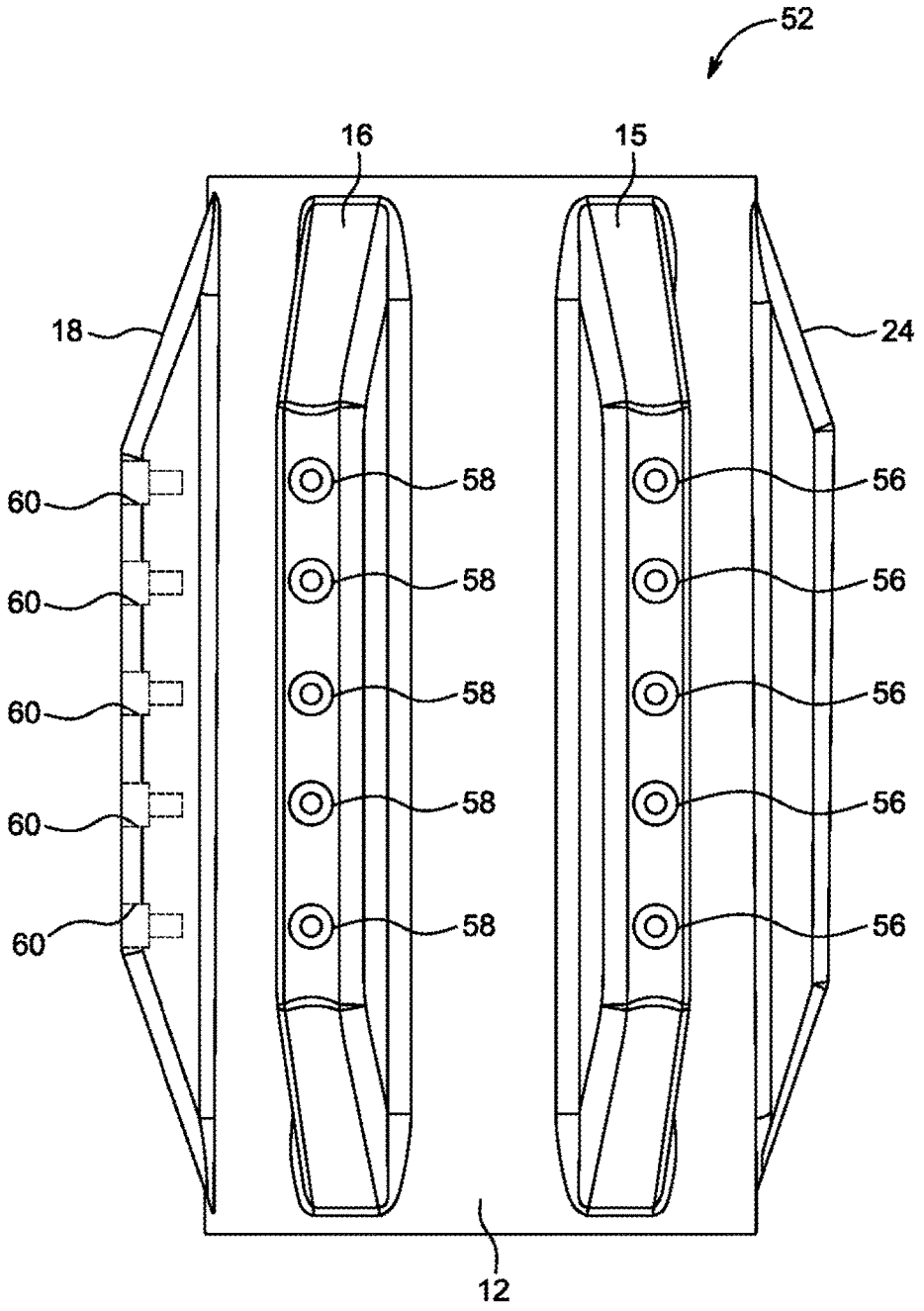

In an exemplary embodiment, as illustrated in FIGS. 32 and 33, a casing centralizer is generally referred to by the reference numeral 54 and includes all of the components of the casing centralizer 10, which components are given the same reference numerals. Additionally, a plurality of counterbores 56 are formed in the outer radial surface of the straight vane 15. The counterbores 56 are spaced along the length of the straight vane 15. Likewise, pluralities of counterbores 58 and 60 are formed in the respective outer radial surfaces of the straight vanes 16 and 18. The counterbores 58 and 60 are spaced along the respective lengths of the straight vanes 16 and 18. The sizes and quantities of counterbores can be varied. In several exemplary embodiments, the insertion and operation of the centralizer 54 is identical to that of the centralizer 10. Additionally, the counterbores 56, 58, and 60 reduce contact area (but not footprint), and reduce differential pressure sticking.

Figure 34:
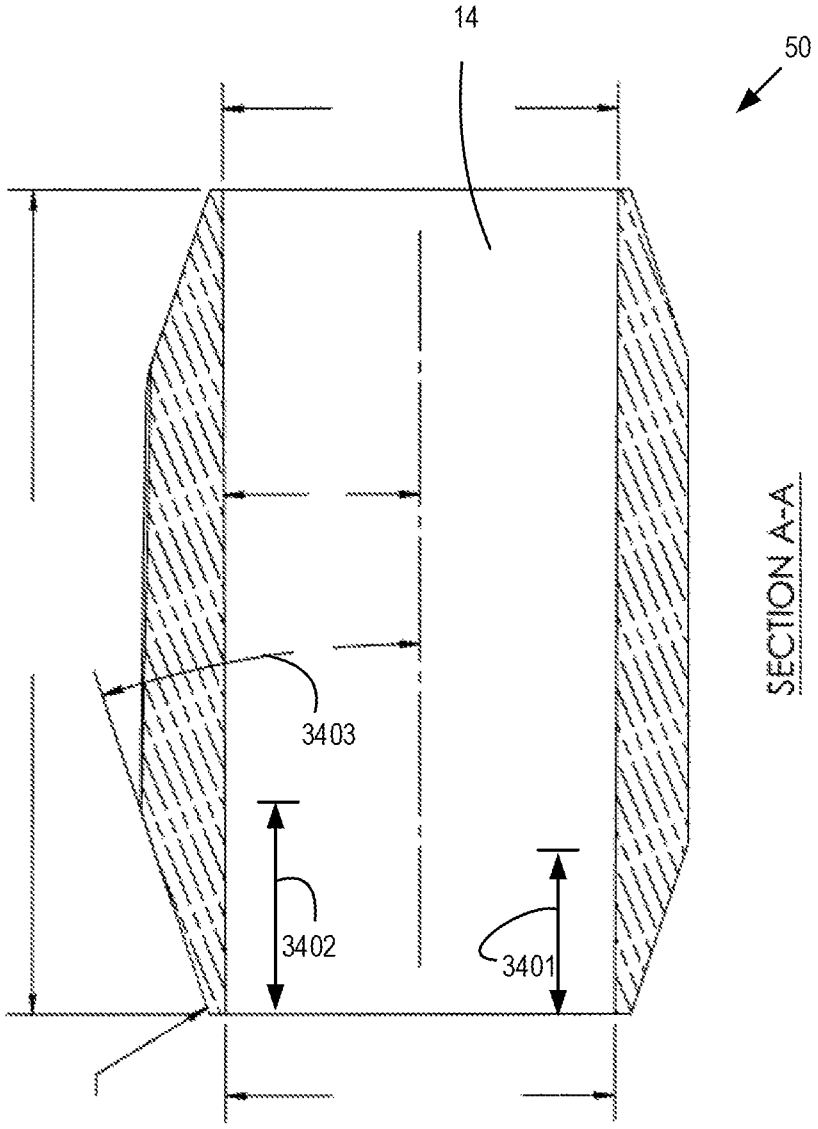
FIG. 34 is a cross-sectional elevation view illustrating a casing centralizer in accordance with at least one embodiment.

FIG. 34 is a cross-sectional elevation view illustrating a casing centralizer in accordance with at least one embodiment.

Figure 35:
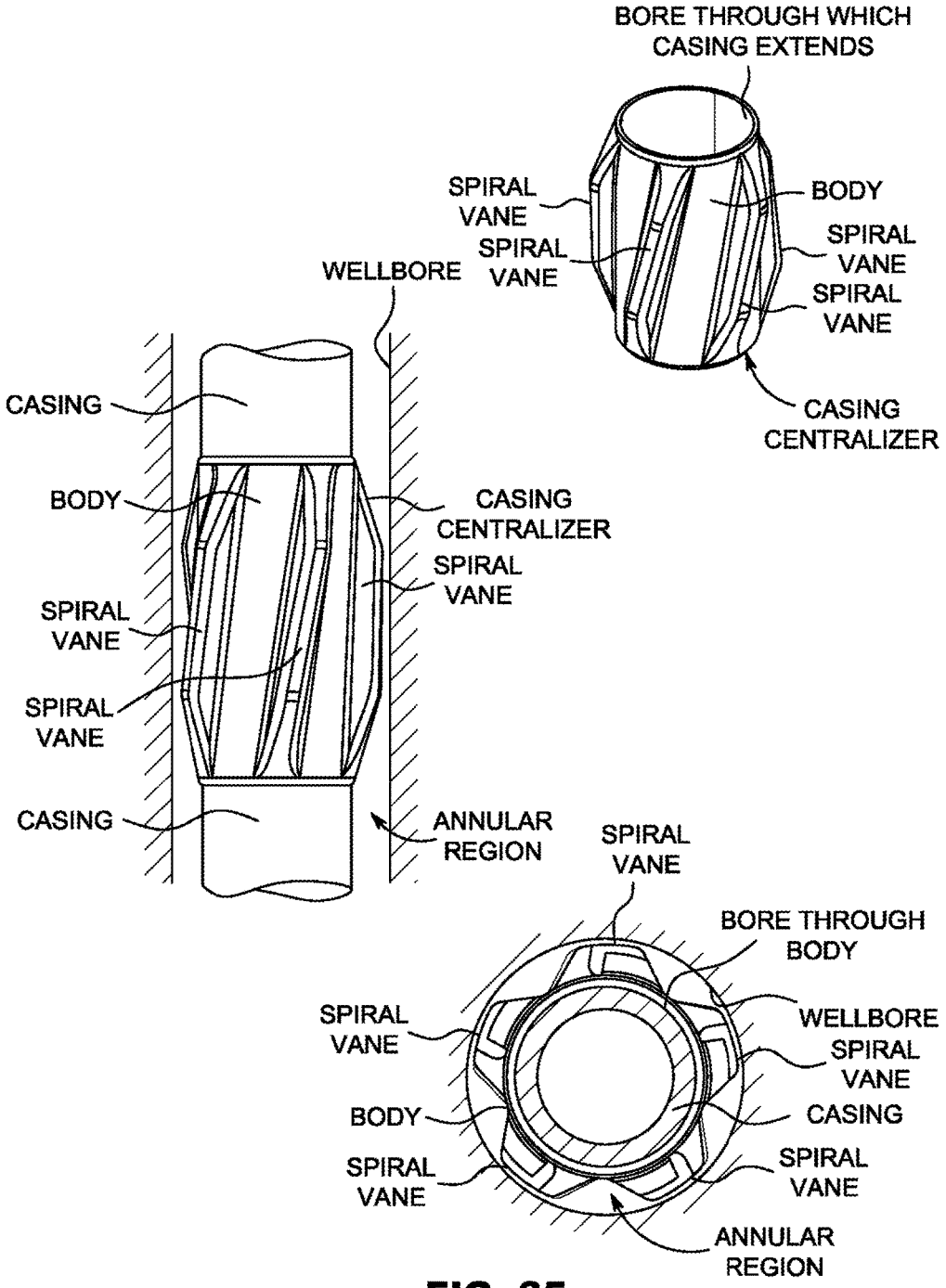
FIG. 35 includes views of a casing centralizer having spiral vanes which may be of different heights in accordance with at least one embodiment.

FIG. 35 includes views of a casing centralizer having spiral vanes which may be of different heights in accordance with at least one embodiment.

Figure 36:
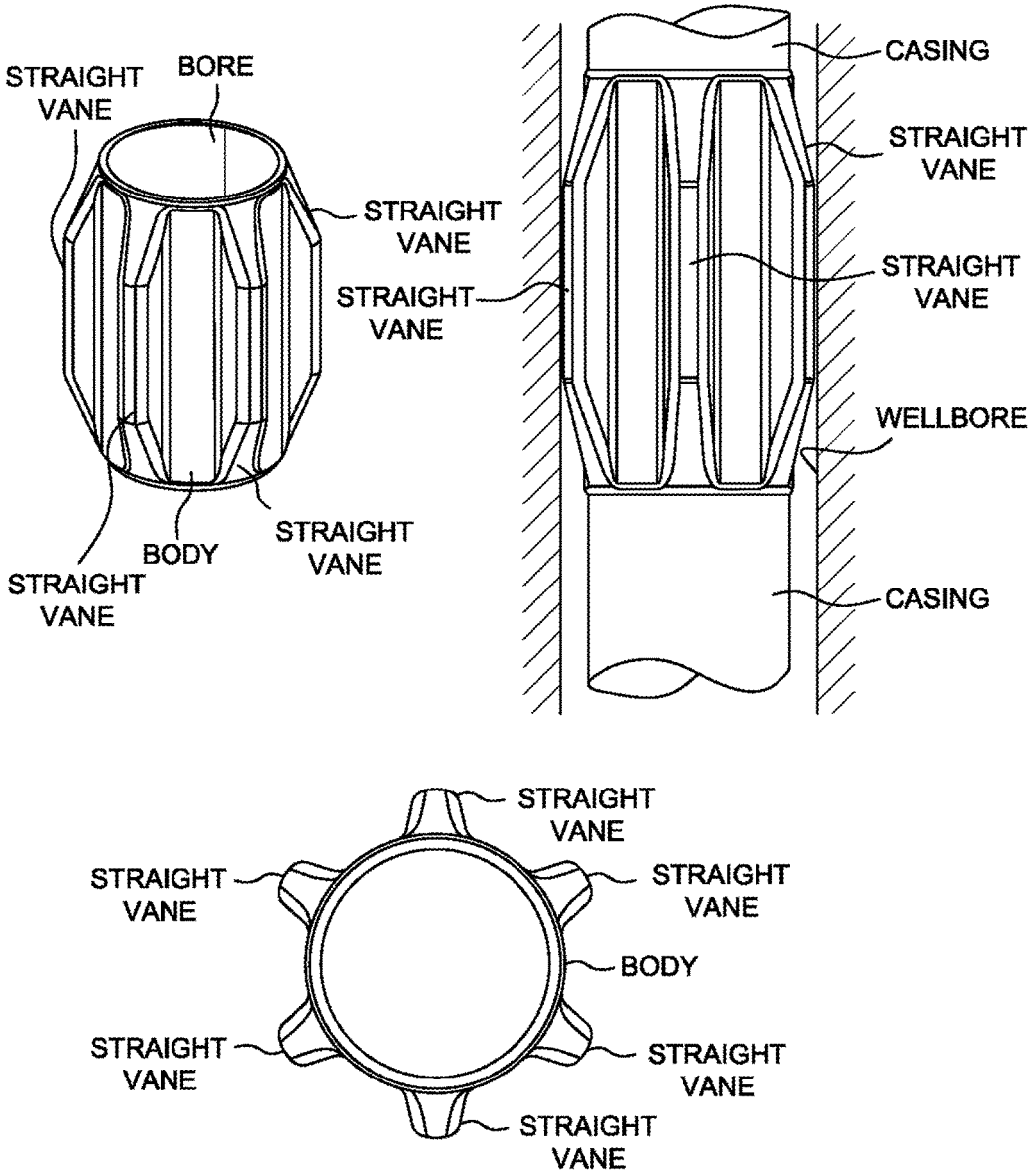
FIG. 36 includes views of a casing centralizer having straight vanes which may be of different heights in accordance with at least one embodiment.

FIG. 36 includes views of a casing centralizer having straight vanes which may be of different heights in accordance with at least one embodiment.

Figure 37:
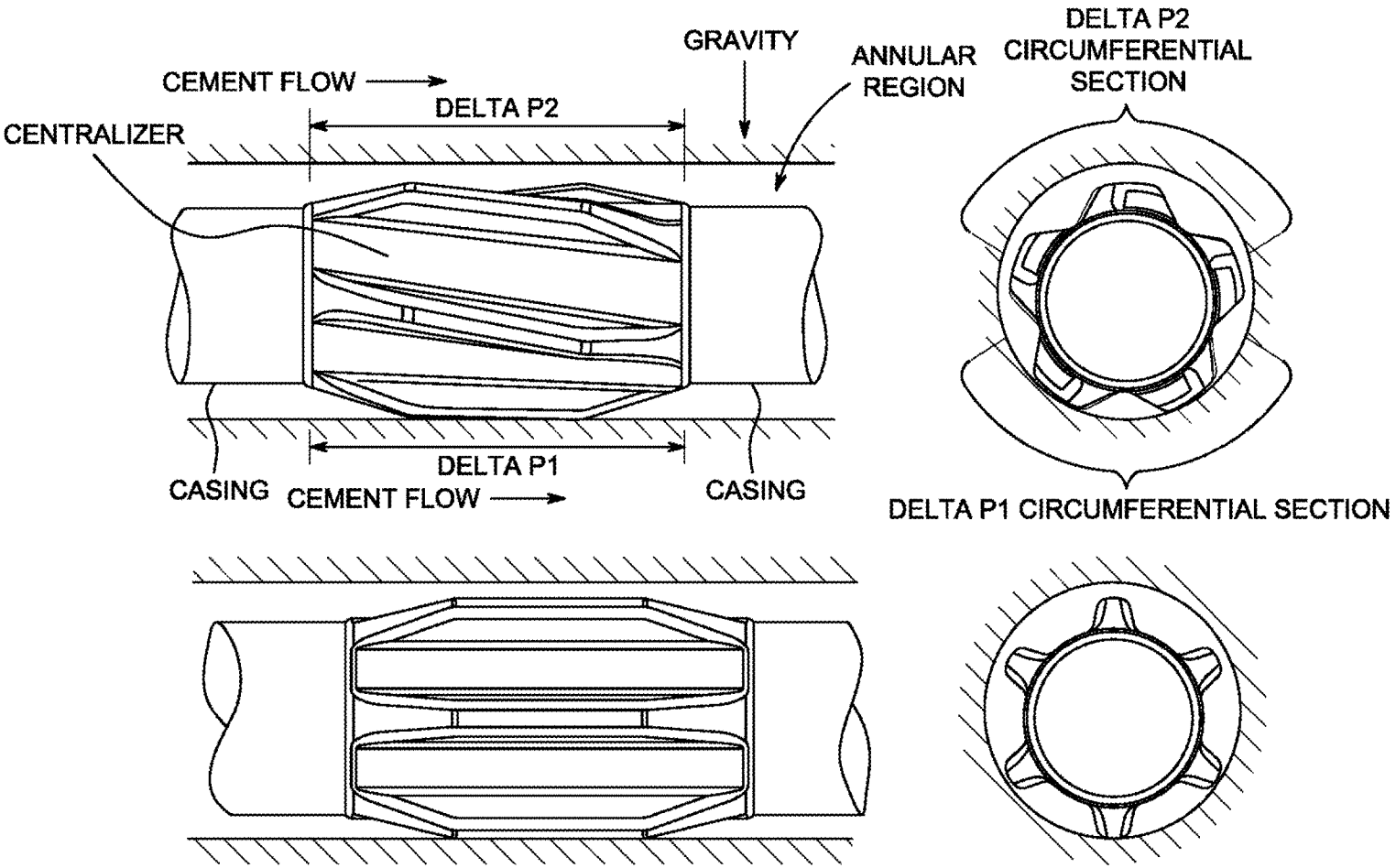
FIG. 37 includes views of two casing centralizers, one of which has spiral vanes which may be of different heights, and one of which has straight vanes which may be of different heights, in accordance with at least one embodiment.

FIG. 37 includes views of two casing centralizers, one of which has spiral vanes which may be of different heights, and one of which has straight vanes which may be of different heights, in accordance with at least one embodiment.

Figure 38:
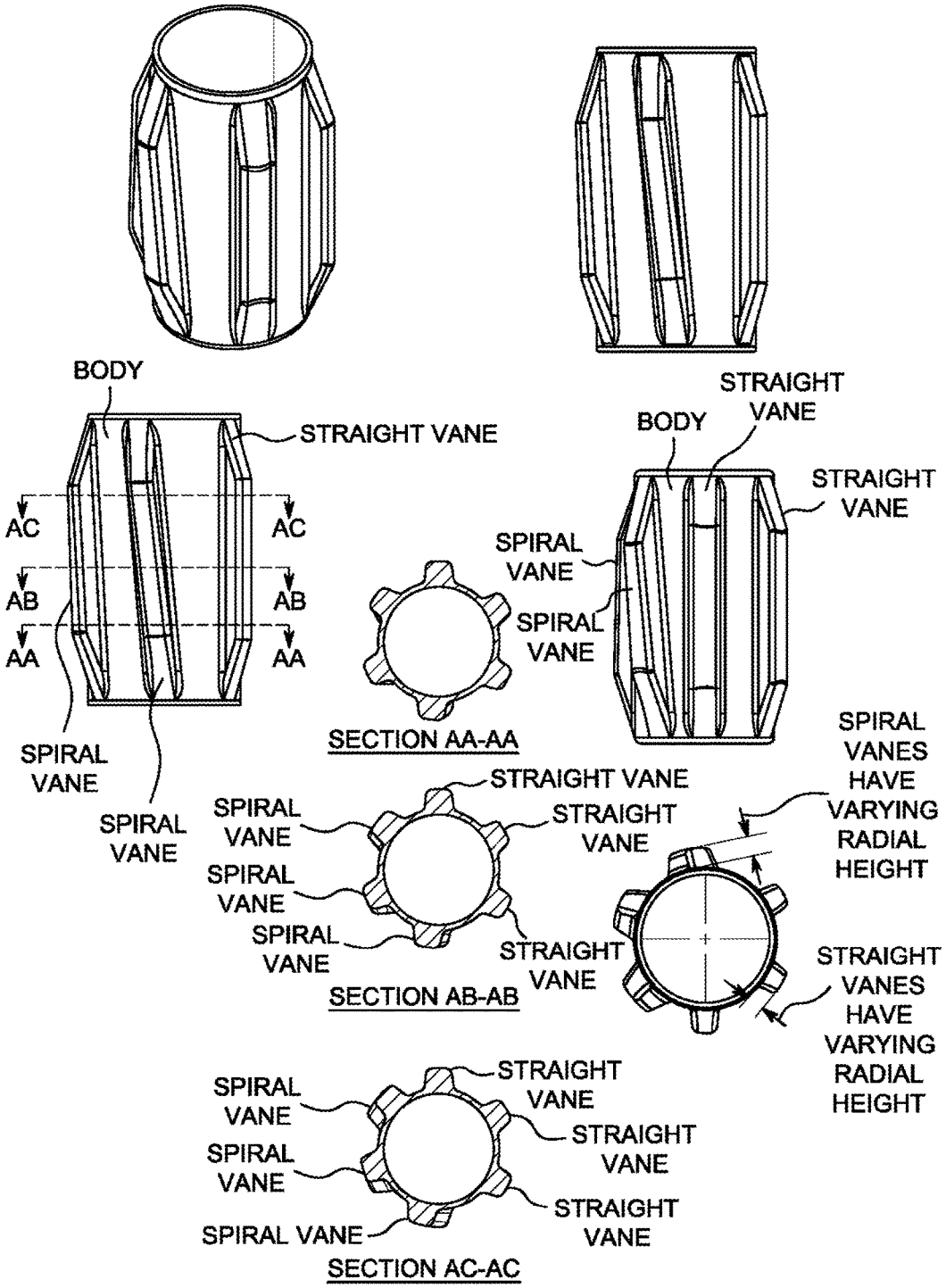
FIG. 38 includes views of a casing centralizer having at least one spiral vane and at least one straight vane in accordance with at least one embodiment.

FIG. 38 includes views of a casing centralizer having at least one spiral vane and at least one straight vane in accordance with at least one embodiment.

Figure 39:
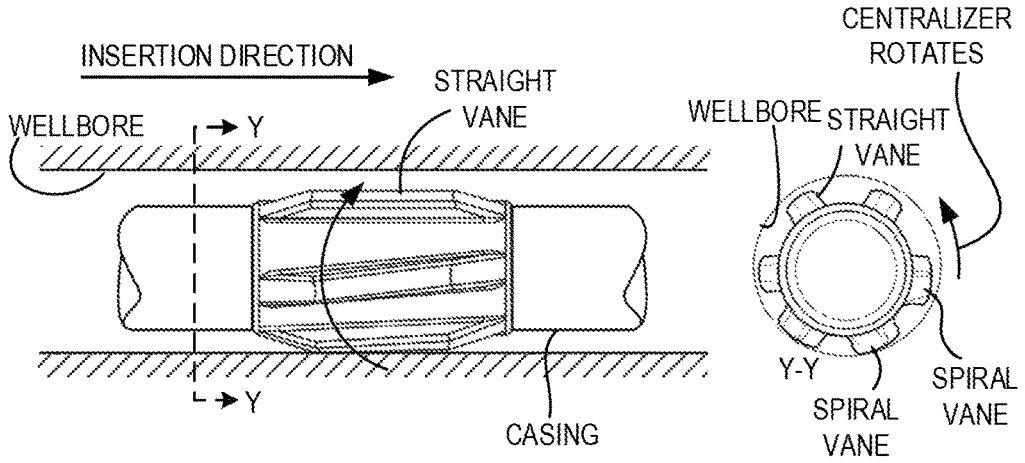
FIG. 39 includes views of a casing centralizer having at least one spiral vane and at least one straight vane in accordance with at least one embodiment in both a suboptimally rotated orientation and an optimally rotated orientation.
Figure 39:
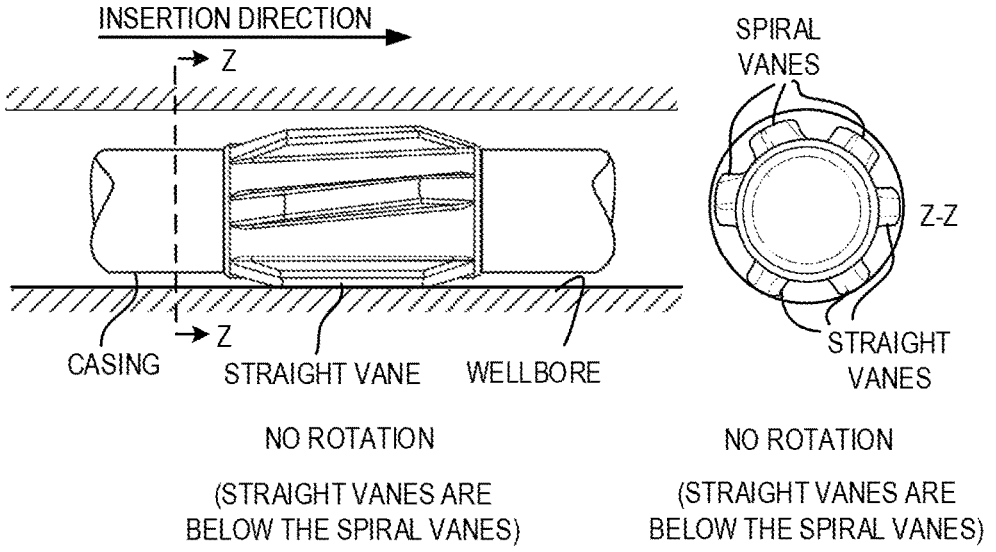

FIG. 39 includes views of a casing centralizer having at least one spiral vane and at least one straight vane in accordance with at least one embodiment in both a suboptimally rotated orientation and an optimally rotated orientation.

Figure 40:
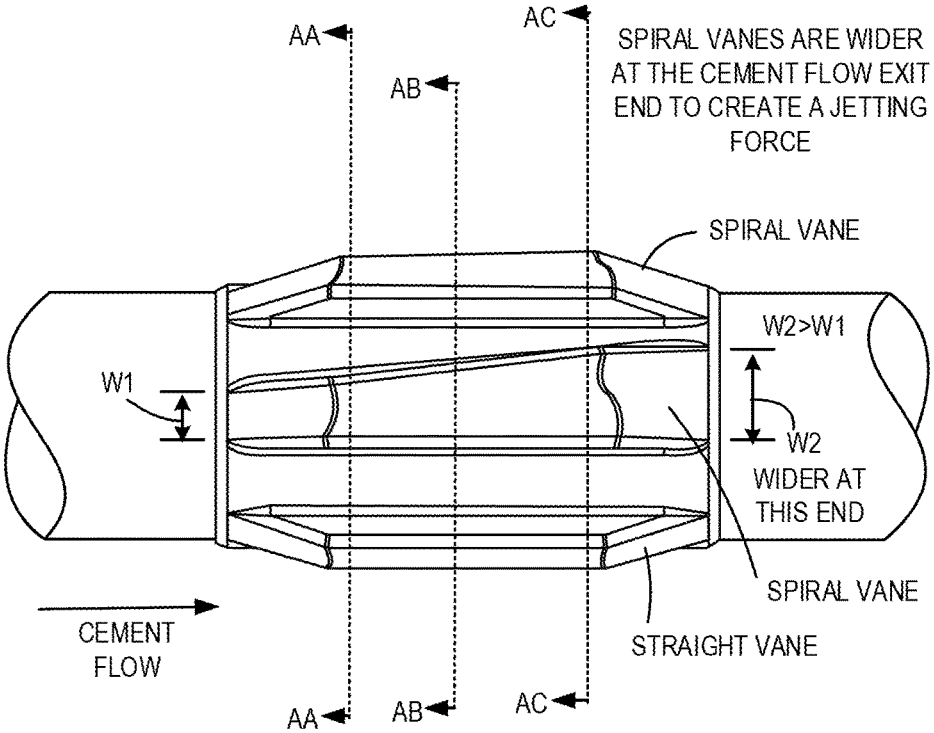
FIG. 40 includes view of a casing centralizer having at least one vane of varying width along its length in accordance with at least one embodiment.
Figure 40:
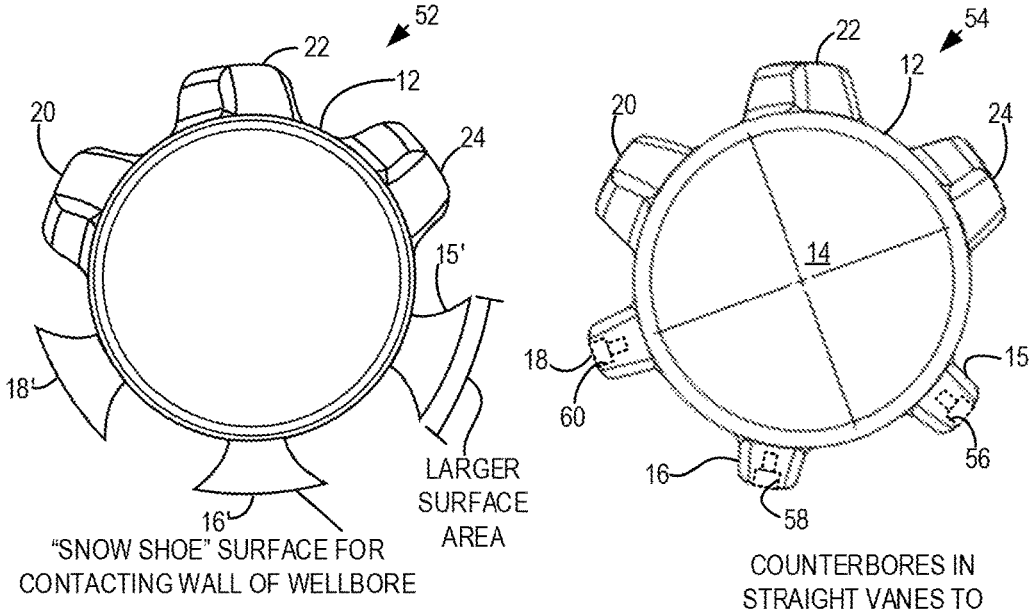

FIG. 40 includes view of a casing centralizer having at least one vane of varying width along its length in accordance with at least one embodiment.

Figure 41:
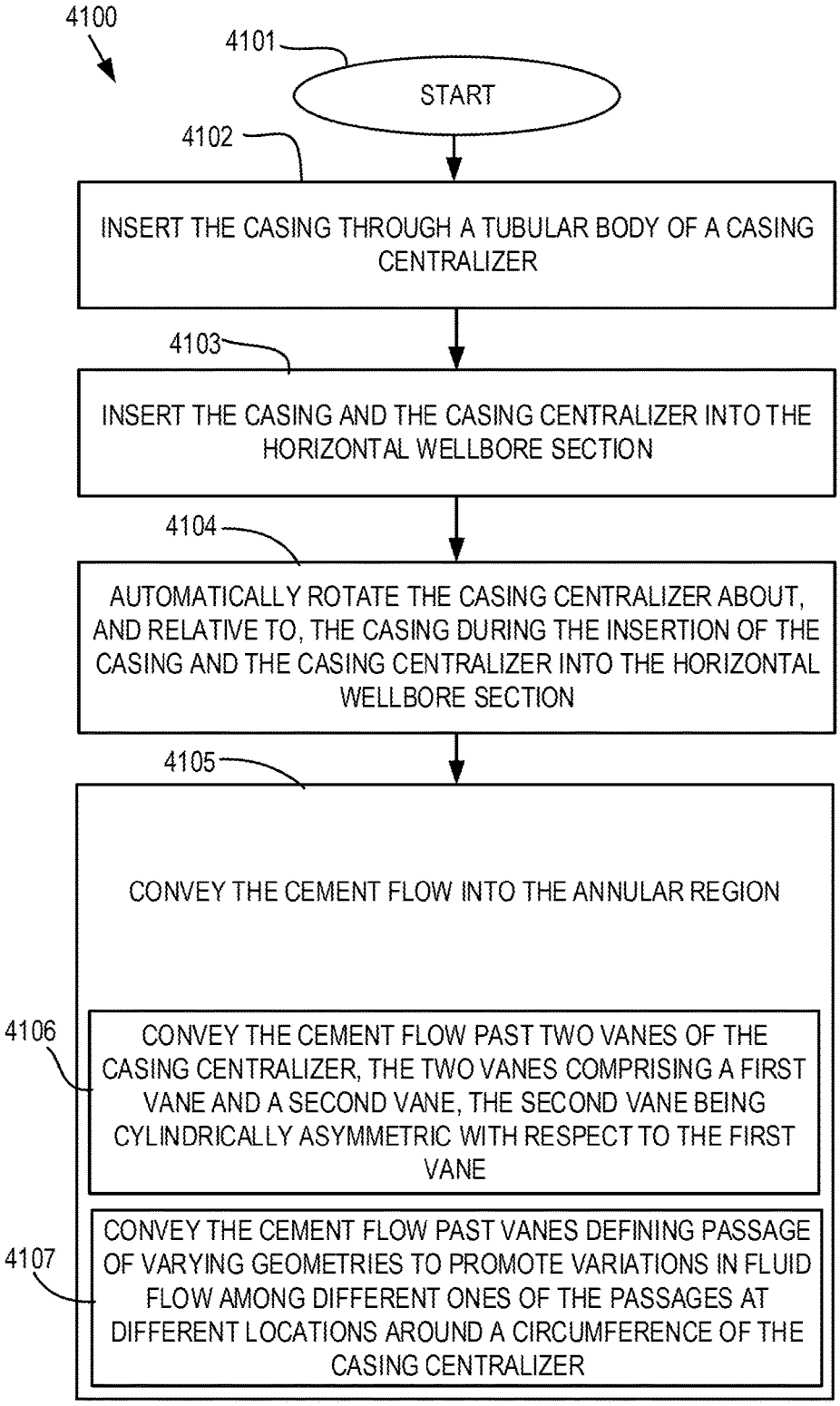
FIG. 41 is a flow diagram of a method in accordance with at least one embodiment.

FIG. 41 is a flow diagram of a method in accordance with at least one embodiment. Method 4100 is a method of facilitating the distribution of cement flow in an annular region defined between a casing and a wall of a horizontal wellbore section through which the casing extends. Method 4100 begins in block 4101 and continues to block 4102. At block 4102, the casing is inserted through a tubular body of a casing centralizer. The casing centralizer further comprising first and second circumferential sections. From block 4102, method 4100 continues to block 4103. At block 4103, the casing and the casing centralizer are inserted into the horizontal wellbore section. From block 4103, method 4100 continues to block 4104. At block 4104, the casing centralizer is automatically rotated about, and relative to, the casing during the insertion of the casing and the casing centralizer into the horizontal wellbore section, wherein the casing centralizer is automatically rotated within the horizontal wellbore section at least until at least a portion of the first circumferential section is positioned below at least a portion of the second circumferential section. From block 4104, method 4100 continues t block 4105. At block 4105, the cement flow is conveyed into the annular region. In accordance with at least one embodiment, during the conveyance of the cement flow into the annular region a first pressure drop is defined across the length of the tubular body at a first circumferential location within the first circumferential section, a second pressure drop is defined across the length of the tubular body at a second circumferential location within the second circumferential section, and the first pressure drop is less than the second pressure drop to facilitate the distribution of the cement flow in the annular region. In accordance with at least one embodiment, the automatically rotating the casing centralizer occurs in reaction to flow of a fluid past a vane of the casing centralizer. In accordance with at least one embodiment, the automatically rotating the casing centralizer occurs in response to flow of a fluid past a first vane of a first height and a second vane of a second height, the second height being different than the first height. Block 4105 comprises block 4106. In accordance with at least one embodiment, at block 4106, the conveying the cement flow into the annular region further comprises conveying the cement flow past two vanes of the casing centralizer, the two vanes comprising a first vane and a second vane, the second vane being cylindrically asymmetric with respect to the first vane. Block 4105 comprises block 4107. In accordance with at least one embodiment, at block 4107, the conveying the cement flow into the annular region further comprises conveying the cement flow past vanes defining passages of varying geometries to promote variations in fluid flow among different ones of the passages at different locations around a circumference of the casing centralizer.

In several exemplary embodiments, for any of the above-described casing centralizers, the quantity of spiral vanes, the quantity of straight vanes, the quantity of all vanes, and/or the respective radial heights of one or more of the vanes, may be increased or decreased.

In several exemplary embodiments, each of the above-described casing centralizers has an azimuthally decreasing axial (or longitudinal) pressure gradient from the top (at the top center vane or thereabout, that is, at the 12 o'clock position within the horizontal wellbore section) to the bottom (at the bottom center vane or thereabout, that is, at the 6 o'clock position within the horizontal wellbore section); this azimuthally decreasing axial pressure gradient, from the top to the bottom, increases fluid velocity in the narrow annular gap between the centralizer and the lower half of the horizontal wellbore section.

In several exemplary embodiments, a casing centralizer includes a center spiral vane that is taller than at least two outer spiral vanes, and a center straight vane that is shorter than at least two outer straight vanes; wherein the outer spiral vanes are taller than the outer straight vanes; in an exemplary embodiment, the only stable position for the centralizer within a horizontal wellbore section will be with the straight vanes at the bottom, that is, positioned below the spiral vanes.

In several exemplary embodiments, one or more of the exemplary embodiments described and illustrated are combined in whole or in part with one or more of the other exemplary embodiments described and illustrated.

In several exemplary embodiments, one or more of the exemplary embodiments of the centralizers described above and illustrated in FIGS. 1-33 are composed of one or more metallic materials, one or more non-metallic materials, or any combination thereof.

The present disclosure introduces a casing centralizer that includes a body having a bore through which casing is adapted to extend; a plurality of spiral vanes, each of which extends spirally and longitudinally along the length of the body, the spiral vanes being spaced circumferentially about the body, the circumferential spacing of the spiral vanes defining a first contiguous circumferential section about the body; and a plurality of straight vanes, each of which extends longitudinally along the length of the body in a straight direction, the straight vanes being spaced circumferentially about the body, the circumferential spacing of the straight vanes defining a second contiguous circumferential section about the body, the second contiguous circumferential section being separate from the first contiguous circumferential section. In an exemplary embodiment, when the casing extends through the bore of the body and the casing and the casing centralizer are being inserted into a horizontal wellbore section, the plurality of spiral vanes urge the casing centralizer to rotate about, and relative to, the casing, and the casing centralizer continues to so rotate until the straight vanes are positioned below the spiral vanes. In an exemplary embodiment, when the casing centralizer extends in a horizontal wellbore section: a first flow resistance is defined across the length of the body and at a first circumferential location within the first contiguous circumferential section; a second flow resistance is defined across the length of the body and at a second circumferential location within the second contiguous circumferential section; the second flow resistance is less than the first flow resistance and thus the pressure drop across the length of the body at the second circumferential location is less than the pressure drop across the length of the body at the first circumferential location. In an exemplary embodiment, two or more of the spiral vanes have different radial heights; wherein the difference in radial heights between the two or more spiral vanes promotes rotation of the casing centralizer about, and relative to, the casing. In an exemplary embodiment, two or more of the straight vanes have different radial heights; wherein the difference in radial heights between the two or more straight vanes facilitates stopping the rotation of the casing centralizer about, and relative to, the casing when the straight vanes are positioned below the spiral vanes in a horizontal wellbore section.

The present disclosure also introduces a method of facilitating the distribution of cement flow in an annular region defined between a casing and a wall of a horizontal wellbore section through which the casing extends, the method including inserting the casing through a body of a casing centralizer, the casing centralizer further including first and second circumferential sections; inserting the casing and the casing centralizer into the horizontal wellbore section; automatically rotating the casing centralizer about, and relative to, the casing during the insertion of the casing and the casing centralizer into the horizontal wellbore, wherein the casing centralizer is automatically rotated within the horizontal wellbore section at least until at least a portion of the first circumferential section is positioned below at least a portion of the second circumferential section; and conveying the cement flow into the annular region; wherein, during the conveyance of the cement flow into the annular region: a first pressure drop is defined across the length of the body at a first circumferential location within the first circumferential section, a second pressure drop is defined across the length of the body at a second circumferential location within the second circumferential section, and the first pressure drop is less than the second pressure drop to facilitate the distribution of the cement flow in the annular region.

The present disclosure also introduces an apparatus according to one or more aspects of the present disclosure.

The present disclosure also introduces a method according to one or more aspects of the present disclosure.

The present disclosure also introduces a system according to one or more aspects of the present disclosure.

The present disclosure also introduces a kit according to one or more aspects of the present disclosure.

The present disclosure also introduces a casing centralizer according to one or more aspects of the present disclosure.

The present disclosure also introduces a tubular string according to one or more aspects of the present disclosure.

The present disclosure also introduces a casing according to one or more aspects of the present disclosure.

The present disclosure also introduces an assembly according to one or more aspects of the present disclosure.

In accordance with at least one embodiment, a casing centralizer operates to center, or centralize, a tubular string or casing within a wellbore used in oil and gas exploration and production operations. This centralization facilitates the insertion of cement in an annular region defined between the outside surface of the casing and the wall of the wellbore. The casing centralizer includes a body having a bore through which the casing extends, and a plurality of vanes that extend along the body. The vanes can either be straight vanes that extend in a straight line along the body, or spiral vanes that extend spirally along the body.

In some cases, and especially in horizontal wellbore sections, a maldistribution of flowing cement is created because the casing centralizer settles on the bottom half of the horizontal wellbore wall, creating a pressure drop longitudinally across the casing centralizer at the bottom half of the horizontal wellbore wall (Delta P1) that is greater than the pressure drop longitudinally across the casing centralizer at the top half of the horizontal wellbore wall (Delta P2) (Delta P1>Delta P2). Flow of cement is choked at the bottom half of the horizontal wellbore wall, creating a maldistribution of cement flow in the annular region. This problem exists regardless of whether the casing centralizer includes spiral vanes or straight vanes.

At least one embodiment provides a casing centralizer that self-aligns (or self-rotates) within a horizontal wellbore section during insertion of the casing within the horizontal wellbore section so that the pressure drop longitudinally across the casing centralizer at the bottom half of the horizontal wellbore wall (Delta P1) is less than the pressure drop longitudinally across the casing centralizer at the top half of the horizontal wellbore wall (Delta P2) (Delta P1<Delta P2). This self-aligning centralizer includes a plurality of spiral vanes, and a plurality of straight vanes. The spiral vanes are located on one circumferential section of the annular body, and the straight vanes are located on the other circumferential section.

During the insertion of the casing in the horizontal wellbore section, the spiral vanes engage the wall of the wellbore and/or other debris, urging the casing centralizer to rotate about, and relative to, the casing. The casing centralizer continues to so rotate, until the straight vanes are adjacent the bottom half of the horizontal wellbore wall. At this point, the casing centralizer is no longer urged to rotate during installation.

To promote rotation, one or more of the spiral vanes can have varying radial heights (some spiral vanes are taller than others). To facilitate stopping rotation so that the straight vanes are positioned below the spiral vanes, one or more of the straight vanes can have varying radial heights (some straight vanes are taller than others).

After the casing has been fully inserted in the horizontal wellbore section, a cementing operation is initiated, which results in cement flowing in the annular region defined between the casing and wall of the wellbore. The pressure drop longitudinally across the casing centralizer at the bottom half of the horizontal wellbore wall (Delta P1) is less than the pressure drop longitudinally across the casing centralizer at the top half of the horizontal wellbore wall (Delta P2). That is, the spiral vanes result in a relatively larger pressure drop across the top circumferential half of the casing centralizer. And the straight vanes result in a relatively smaller pressure drop across the bottom circumferential half of the casing centralizer. This counteracts the effects of gravity and the settling of the casing centralizer against the bottom half of the wellbore wall.

In accordance with at least one embodiment, spiral vanes are wider at the cement flow exit end to create a jetting force. In accordance with at least one embodiment, "Snow Shoe" straight vanes to increase footprint so that vane doesn't sink into earth. In accordance with at least one embodiment, the "Snow Shoe" straight vanes have a dovetail profile, being narrower (in cross-sectional width) at their inner radial limit, where they meet the tubular body of the casing centralizer and wider (in cross-sectional width) at their outer radial limit, where they are adapted to contact the wellbore. In accordance with at least one embodiment, counterbores are defined in straight vanes to reduce differential pressure sticking. The counterbores can be implemented as blind cavities extending radially inward from a radially outer surface of a vane. The counterbores can reduce the area of the radially outer surface of the vane, which is adapted to contact the wellbore. Thus, the counterbores can be adapted to reduce the surface area of contact between the vane and the wellbore. The reduction in surface area of contact can reduce differential pressure sticking.

Spiral blades can be implemented using either chiral orientation (i.e., left hand twist or right hand twist). In accordance with at least one embodiment, different vanes can have different chiral orientations. As an example, one vane may have a left hand twist, while an adjacent vane may have a right hand twist. The two vanes may cooperatively define a passage for fluid flow between them. The passage may vary in volume along a length of the two vanes. The volume may, for example, monotonically decrease along the length of the two vanes. The decrease in volume may form a nozzle. The nozzle may accelerate a velocity of the fluid flowing through the passage. The accelerated fluid flow may be used for jetting, to remove accumulations of undesired material, such as gelled mud, along the wellbore wall.

In accordance with at least one embodiment, a casing centralizer comprises a tubular body defining an internal passage through which casing is adapted to extend; a plurality of spiral vanes, each of which extends spirally and longitudinally along at least a portion of a length of the tubular body, the spiral vanes being spaced circumferentially about the tubular body, the circumferential spacing of the spiral vanes defining a first contiguous circumferential section about the tubular body; and a plurality of straight vanes, each of which extends longitudinally along the at least the portion of the length of the tubular body in a straight direction, the straight vanes being spaced circumferentially about the tubular body, the circumferential spacing of the straight vanes defining a second contiguous circumferential section about the tubular body, the second contiguous circumferential section being separate from the first contiguous circumferential section. In accordance with at least one embodiment, when the casing extends through the internal passage of the tubular body and the casing and the casing centralizer are being inserted into a horizontal wellbore section, the plurality of spiral vanes urge the casing centralizer to rotate about, and relative to, the casing, and the casing centralizer continues to so rotate until the straight vanes are positioned below the spiral vanes. In accordance with at least one embodiment, when the casing centralizer extends in a horizontal wellbore section, a first flow resistance is defined across the length of the tubular body and at a first circumferential location within the first contiguous circumferential section; a second flow resistance is defined across the length of the tubular body and at a second circumferential location within the second contiguous circumferential section; and the second flow resistance is less than the first flow resistance and thus the pressure drop across the length of the tubular body at the second circumferential location is less than the pressure drop across the length of the tubular body at the first circumferential location. In accordance with at least one embodiment, the first flow resistance corresponds to the spiral vanes. In accordance with at least one embodiment, the second flow resistance corresponds to the straight vanes. In accordance with at least one embodiment, the first circumferential location corresponds to the spiral vanes. In accordance with at least one embodiment, the second circumferential location corresponds to the straight vanes. In accordance with at least one embodiment, two or more of the spiral vanes have different radial heights, wherein the difference in radial heights between the two or more spiral vanes promotes rotation of the casing centralizer about, and relative to, the casing. In accordance with at least one embodiment, at least one spiral vane is taller than at least one other spiral vane. In accordance with at least one embodiment, two or more of the straight vanes have different radial heights; wherein the difference in radial heights between the two or more straight vanes facilitates stopping the rotation of the casing centralizer about, and relative to, the casing when the straight vanes are positioned below the spiral vanes in a horizontal wellbore section. In accordance with at least one embodiment, at least one straight vane is taller than at least one other straight vane. In accordance with at least one embodiment, the plurality of spiral vanes comprises a spiral vane of non-constant width. In accordance with at least one embodiment, the spiral vane of non-constant width increases in width from a first end of the spiral vane to a second end of the spiral vane. In accordance with at least one embodiment, the spiral vane of non-constant width, along with an adjacent vane, defines a passage between the spiral vane and the adjacent vane of decreasing volume from the first end of the spiral vane and the second end of the spiral vane.

In accordance with at least one embodiment, a method of facilitating the distribution of cement flow in an annular region defined between a casing and a wall of a horizontal wellbore section through which the casing extends is provided. The method comprises inserting the casing through a tubular body of a casing centralizer, the casing centralizer further comprising first and second circumferential sections; inserting the casing and the casing centralizer into the horizontal wellbore section; automatically rotating the casing centralizer about, and relative to, the casing during the insertion of the casing and the casing centralizer into the horizontal wellbore section, wherein the casing centralizer is automatically rotated within the horizontal wellbore section at least until at least a portion of the first circumferential section is positioned below at least a portion of the second circumferential section; and conveying the cement flow into the annular region, wherein, during the conveyance of the cement flow into the annular region, a first pressure drop is defined across the length of the tubular body at a first circumferential location within the first circumferential section, a second pressure drop is defined across the length of the tubular body at a second circumferential location within the second circumferential section, and the first pressure drop is less than the second pressure drop to facilitate the distribution of the cement flow in the annular region. In accordance with at least one embodiment, the automatically rotating the casing centralizer occurs in reaction to flow of a fluid past a vane of the casing centralizer. In accordance with at least one embodiment, the automatically rotating the casing centralizer occurs in response to flow of a fluid past a first vane of a first height and a second vane of a second height, the second height being different than the first height. In accordance with at least one embodiment, the conveying the cement flow into the annular region further comprises conveying the cement flow past two vanes of the casing centralizer, the two vanes comprising a first vane and a second vane, the second vane being cylindrically asymmetric with respect to the first vane. In accordance with at least one embodiment, the conveying the cement flow into the annular region further comprises conveying the cement flow past vanes defining passages of varying geometries to promote variations in fluid flow among different ones of the passages at different locations around a circumference of the casing centralizer. In accordance with at least one embodiment, at least a portion of the first circumferential section corresponds to straight vanes. In accordance with at least one embodiment, at least a portion of the second circumferential section corresponds to spiral vanes. In accordance with at least one embodiment, the first pressure drop corresponds to the straight vanes. In accordance with at least one embodiment, the second pressure drop corresponds to the spiral vanes.

In accordance with at least one embodiment, a casing centralizer comprise a tubular body defining an internal passage through which casing is adapted to extend; a first vane of a first geometry projecting longitudinally along an exterior of the tubular body; a first adjacent vane at a first angular offset from the first vane and defining, along with the first vane, a first passage for fluid flow, the first passage presenting a first fluid flow resistance to the fluid flow; a second vane of a second geometry projecting longitudinally along the exterior of the tubular body at a second angular offset from the first vane; and a second adjacent vane at a third angular offset from the second vane and defining, along with the second vane, a second passage for fluid flow, the second passage presenting a second fluid flow resistance to the fluid flow, the second fluid flow resistance being different than the first fluid flow resistance. In accordance with at least one embodiment, the first vane is a straight vane, and the second vane is a spiral vane. In accordance with at least one embodiment, the second vane has a different rotational pitch than the first vane. In accordance with at least one embodiment, the second vane has a variation in width along its length. In accordance with at least one embodiment, the first vane has a uniform width along its length. In accordance with at least one embodiment, the first vane has a first radial height and the second vane has a second radial height, the second radial height being different than the first radial height. In accordance with at least one embodiment, the first vane has a dovetail cross section.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical,"

"horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the exemplary embodiments disclosed above, or variations thereof, may be combined in whole or in part with any one or more of the other exemplary embodiments described above or variations thereof.

Although several exemplary embodiments have been disclosed in detail above, the embodiments disclosed are exemplary only and are not limiting, and those skilled in the art will readily appreciate that many other modifications, changes, and substitutions are possible in the exemplary embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A casing centralizer, comprising:

a tubular body defining an internal passage through which casing is adapted to extend;

a plurality of spiral vanes, each of which spirals the same direction and each of which extends spirally and longitudinally along at least a portion of a length of the tubular body, the spiral vanes being spaced circumferentially about the tubular body, the circumferential spacing of the spiral vanes defining a first contiguous circumferential section about the tubular body; and a plurality of straight vanes, each of which extends longitudinally along the at least the portion of the length of the tubular body in a straight direction, the straight vanes being spaced circumferentially about the tubular body, the circumferential spacing of the straight vanes defining a second contiguous circumferential section about the tubular body, the second contiguous circumferential section being separate from the first contiguous circumferential section.

2. The casing centralizer of claim 1 wherein, when the casing extends through the internal passage of the tubular body and the casing and the casing centralizer are being inserted into a horizontal wellbore section, the plurality of spiral vanes urge the casing centralizer to rotate about, and relative to, the casing, and the casing centralizer continues to so rotate until the straight vanes are positioned below the spiral vanes.

3. The casing centralizer of claim 1 wherein, when the casing centralizer extends in a horizontal wellbore section:

a first flow resistance is defined across the length of the tubular body and at a first circumferential location within the first contiguous circumferential section;

a second flow resistance is defined across the length of the tubular body and at a second circumferential location within the second contiguous circumferential section; and the second flow resistance is less than the first flow resistance and thus the pressure drop across the length of the tubular body at the second circumferential location is less than the pressure drop across the length of the tubular body at the first circumferential location.

4. The casing centralizer of claim 1, wherein two or more of the spiral vanes have different radial heights;

wherein the difference in radial heights between the two or more spiral vanes promotes rotation of the casing centralizer about, and relative to, the casing.

5. The casing centralizer of claim 1, wherein two or more of the straight vanes have different radial heights;

wherein the difference in radial heights between the two or more straight vanes facilitates stopping the rotation of the casing centralizer about, and relative to, the casing when the straight vanes are positioned below the spiral vanes in a horizontal wellbore section.

6. The casing centralizer of claim 1, wherein the plurality of spiral vanes comprises a spiral vane of non-constant width.

7. The casing centralizer of claim 6, wherein the spiral vane of non-constant width increases in width from a first end of the spiral vane to a second end of the spiral vane.

8. The casing centralizer of claim 7, wherein the spiral vane of non-constant width, along with an adjacent vane, defines a passage between the spiral vane and the adjacent vane of decreasing volume from the first end of the spiral vane and the second end of the spiral vane.

9. The casing centralizer of claim 1, wherein heights of the vanes decrease around the tubular body, placing the vane with highest height is the vane closest to the vane with lowest height.

10. The casing centralizer of claim 1, wherein at least one of the plurality of straight vanes or one of the plurality of spiral vanes has at least one counterbore.

11. A method of facilitating the distribution of cement flow in an annular region defined between a casing and a wall of a horizontal wellbore section through which the casing extends, the method comprising:

inserting the casing through a tubular body of a casing centralizer, the casing centralizer comprising a plurality of straight vanes and a plurality of spiral vanes, each of the plurality of spiral vanes oriented to spiral the same direction and further comprising first and second circumferential sections;

inserting the casing and the casing centralizer into the horizontal wellbore section;

automatically rotating the casing centralizer about, and relative to, the casing during the insertion of the casing and the casing centralizer into the horizontal wellbore section, wherein the casing centralizer is automatically rotated within the horizontal wellbore section at least until at least a portion of the first circumferential section is positioned below at least a portion of the second circumferential section; and conveying the cement flow into the annular region;

wherein, during the conveyance of the cement flow into the annular region:

a first pressure drop is defined across the length of the tubular body at a first circumferential location within the first circumferential section, a second pressure drop is defined across the length of the tubular body at a second circumferential location within the second circumferential section, and the first pressure drop is less than the second pressure drop to facilitate the distribution of the cement flow in the annular region.

12. The method of claim 11 wherein the automatically rotating the casing centralizer occurs in reaction to flow of a fluid past a vane of the casing centralizer.

13. The method of claim 11 wherein the automatically rotating the casing centralizer occurs in response to flow of a fluid past a first vane of a first height and a second vane of a second height, the second height being different than the first height.

14. The method of claim 11 wherein the conveying the cement flow into the annular region further comprises:

conveying the cement flow past vanes defining passages of varying geometries to promote variations in fluid flow among different ones of the passages at different locations around a circumference of the casing centralizer.

15. A casing centralizer comprising:

a tubular body defining an internal passage through which casing is adapted to extend;

a first vane of a first geometry projecting longitudinally along an exterior of the tubular body;

a first adjacent vane at a first angular offset from the first vane and defining, along with the first vane, a first passage for fluid flow, the first passage presenting a first fluid flow resistance to the fluid flow;

a second vane of a second geometry projecting longitudinally along the exterior of the tubular body at a second angular offset from the first vane; and a second adjacent vane at a third angular offset from the second vane and defining, along with the second vane, a second passage for fluid flow, the second passage presenting a second fluid flow resistance to the fluid flow, the second fluid flow resistance being different than the first fluid flow resistance;

wherein at least one of the vanes is a straight vane and at least two of the vanes are spiral vanes, and each of the spiral vanes spiral in the same direction.

16. The casing centralizer of claim 15 wherein the first vane is a straight vane, and the second vane is a spiral vane.

17. The casing centralizer of claim 15 wherein the second vane has a different rotational pitch than the first vane.

18. The casing centralizer of claim 15 wherein the second vane has a variation in width along its length.

19. The casing centralizer of claim 18 wherein the first vane has a uniform width along its length.

20. The casing centralizer of claim 15 wherein the first vane has a first radial height and the second vane has a second radial height, the second radial height being different than the first radial height.

* * * * *